US007179052B2

(12) United States Patent
Sasaki et al.

(10) Patent No.: US 7,179,052 B2
(45) Date of Patent: Feb. 20, 2007

(54) ASSEMBLY TYPE NOZZLE DIAPHRAGM, AND METHOD OF ASSEMBLING THE SAME

(75) Inventors: Takashi Sasaki, Yokohama (JP); Yuji Nakama, Yokohama (JP); Kenichi Imai, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 55 days.

(21) Appl. No.: 10/484,196

(22) PCT Filed: Jul. 18, 2002

(86) PCT No.: PCT/JP02/07325

§ 371 (c)(1),
(2), (4) Date: Jul. 1, 2002

(87) PCT Pub. No.: WO03/008765

PCT Pub. Date: Jan. 30, 2003

(65) Prior Publication Data

US 2004/0253095 A1 Dec. 16, 2004

(30) Foreign Application Priority Data

Jul. 19, 2001 (JP) ..... 2001-219997
Jul. 16, 2002 (JP) ..... 2002-207392

(51) Int. Cl.
*F01D 9/04* (2006.01)

(52) U.S. Cl. ..... 415/209.3; 29/889.22

(58) Field of Classification Search ..... 415/209.3, 415/209.4, 210.1; 29/889.22
See application file for complete search history.

(56) References Cited

U.S. PATENT DOCUMENTS 1,998,951 A * 4/1935 Downer ..... 415/209.4
3,501,246 A * 3/1970 Hickey ..... 415/174.2
5,022,818 A * 6/1991 Scalzo ..... 415/209.3
5,024,579 A * 6/1991 Groenendaal et al. ..... 415/108
5,249,918 A * 10/1993 Knorowski ..... 415/108
5,259,727 A * 11/1993 Quinn ..... 415/190
5,743,711 A 4/1998 Fournier et al.
5,788,456 A * 8/1998 Maier ..... 415/190
6,302,648 B1 * 10/2001 Konishi et al. ..... 415/193

FOREIGN PATENT DOCUMENTS

DE 3003470 6/1981
DE 3341871 5/1985

(Continued)

*Primary Examiner*—Ninh H. Nguyen
(74) *Attorney, Agent, or Firm*—Oblon, Spivak, McClelland, Maier & Neustadt, P.C.

(57) ABSTRACT

A nozzle diaphragm assembly includes a diaphragm outer ring having a groove opened toward an inner diameter side to be continuous in an inner peripheral direction; a diaphragm inner ring having a groove opened toward an outer diameter side to be continuous in an outer peripheral direction; and a nozzle blade having a diaphragm outer ring insertion portion on one end and a diaphragm inner ring insertion portion on the other end, in which the groove opened toward the inner diameter side of the diaphragm outer ring and the diaphragm outer ring insertion portion are shaped to be fitted to each other, and in which the groove opened toward the outer diameter side of the diaphragm inner ring and the diaphragm inner ring insertion portion are shaped to be fitted to each other.

23 Claims, 20 Drawing Sheets

FOREIGN PATENT DOCUMENTS

| | | |
|---|---|---|
| EP | 945597 | 9/1999 |
| EP | 1143106 | 10/2001 |
| GB | 1123586 | 9/1968 |
| GB | 1263639 | 2/1972 |
| GB | 2236809 | 4/1991 |
| JP | 40-29123 | 10/1965 |
| JP | 87402/1973 | 10/1973 |
| JP | 2600955 | 1/1997 |
| JP | 2797723 | 7/1998 |
| JP | 2001-254605 | 9/2001 |

* cited by examiner

LAP-FREE STATE

LAP-PRESENCE STATE

ASSEMBLY TYPE NOZZLE DIAPHRAGM, AND METHOD OF ASSEMBLING THE SAME

TECHNICAL FIELD

The present invention relates to an assembled nozzle diaphragm applied to a steam turbine and a method of assembling the nozzle diaphragm.

BACKGROUND ART

Generally, there has been often provided so-called an axial flow steam turbine, having large capacity, including a plurality of sages, arranged along steam flow direction, each comprising in combination a turbine nozzle (turbine stationary (stator) blade) and a turbine moving or movable (rotor) blade.

The axial flow steam turbines will be roughly classified into reaction type and impulse type.

The steam turbine of the impulse type causes thermal energy of a steam to perform more expansion work using each turbine nozzle, transforms the steam after the expansion work to a deflected flow using each turbine moving blade, and guides the resultant deflected flow to the next stage.

In the turbine nozzle that converts most of the thermal energy of the steam to kinetic energy, a large pressure difference occurs between a steam inlet and a steam outlet of the turbine nozzle. To deal with this pressure difference, therefore, the turbine nozzle adopts a diaphragm structure as shown in FIG. 24.

The turbine nozzle of the diaphragm structure shown in FIG. 24 is constituted as follows. A ring body 1 is divided into two portions on a horizontal joint surface 2, both ends of nozzle blades (nozzle plates) 3 arranged in ring columns are supported by a diaphragm outer ring 4 and a diaphragm inner ring 5, and a labyrinth packing mounting groove 6 is provided in an inner periphery of the diaphragm inner ring 5 that faces a turbine shaft (not shown).

Further, the turbine nozzle is so-called a weld-type turbine nozzle in which at a time when the nozzle blade 3 is connected to the diaphragm outer ring 4 and the diaphragm inner ring 5, the nozzle blade 3 is fixedly attached thereto by welding portions 8*a* and 8*b* through wear plates 7*a* and 7*b*, respectively, as shown in FIG. 25.

On the other hand, in so-called a counter-flow (double flow) turbine that divides the steam flow to a left flow and a right flow at its inlet as shown in FIG. 30, at a time when top sides of a first divided-flow nozzle blade 49 and a second divided-flow nozzle blade 50 are supported by a first divided-flow diaphragm outer ring 52 and a second divided-flow diaphragm outer ring 53, respectively, the first and second divided-flow nozzle blades 49 and 50 are fixedly attached to the first and second divided-flow diaphragm outer rings 52 and 53 by welding portions 54*a* and 54*b* and bottoms of the first and second divided-flow nozzle blades 49 and 50 are fixed by welding portions 54*c* and 54*d* using a shared diaphragm inner ring 51 shared between the first and second divided-flow nozzle blades 49 and 50, respectively.

The weld-type turbine nozzles as shown in FIG. 25 have been employed long and have given actual results. However, as international competition has been increasingly harsh, the market has demanded mare strictly improved performances and cost reduction for turbine nozzles. In light of such demand, the following matters, which have not been regarded seriously, constitute important matters or problems to be considered or solved.

(1) As to performance: deterioration of performance caused by manufacturing error resulting from welding distortion in the case of the weld-type turbine nozzle.

The most serious effect of the welding distortion is the deviation of inside and outside diameters of a steam path from designed diameters, respectively. For example, as shown in FIG. 26, even if the turbine nozzle is designed into so-called a lap (step)-free state in which both a blade root portion (blade base portion) 10 and a blade tip portion (top portion) 11 are formed linearly, both the blade root portion 10 and blade tip portion 11 actually have positive (+) or negative (−) laps relative to the designed values as their respective reference positions as shown in FIG. 27 by the effect of the welding distortion.

A turbine stage efficiency has been confirmed by an experiment based on the positive or negative laps, it has been found that as the positive or negative laps are greater, the deterioration of the turbine stage efficiency is higher. For this reason, even if a method for minimizing the welding distortion is discovered by trial and error, this method naturally has its limit, and as a result of the long-time use of the turbine nozzle, great positive or negative laps often appear again.

Furthermore, a concept of so-called offset design, in which a designed position of the non-dimensional lap is set at a positive position indicated by an arrow AR at the time of design on the assumption that a negative lap occurs, has been introduced so as to try to maintain the turbine stage efficiency at the maximum value (Mmax) during the operation of the turbine nozzle. However, this method naturally has its limit, as well.

(2) As to cost: since there are many welding steps, it is difficult to realize cost reduction.

FIG. 29 illustrates one example in which manufacturing cost composition ratios of the weld-type turbine nozzle in the form of a circular graph. In the example of FIG. 29, a welding cost reaches about 38 percents of a total manufacturing cost. As a result, even if it is attempted to effectively reduce a material cost and a working cost, there is a limit to the cost reduction. In addition, since it is difficult to mechanize and automate welding operation 100 percents, it is difficult to reduce the welding cost itself, accordingly.

The present invention has been achieved under these circumstances. It is an object of the present invention to modify and thereby simplify a turbine nozzle structure and to provide a assembled nozzle diaphragm which can be easily assembled without performing a welding operation and a method of assembling such nozzle diaphragm.

DISCLOSURE OF THE INVENTION

An assembled nozzle diaphragm according to the present invention, to achieve the above-mentioned object, comprises: a diaphragm outer ring having a groove opened toward an inner diameter side to be continuous in an inner peripheral direction of the diaphragm outer ring; a diaphragm inner ring having a groove opened toward an outer diameter side to be continuous in an outer peripheral direction of the diaphragm inner ring; and a nozzle blade having an insertion portion for the diaphragm outer ring provided on one end and having an insertion portion for the diaphragm inner ring provided on the other end, wherein the groove opened toward the inner diameter side of the diaphragm outer ring and the diaphragm outer ring insertion portion of the nozzle blade are shaped to be fitted into each other only in a circumferential direction of each of the groove and the diaphragm outer ring insertion portion, and the groove opened toward the outer diameter side of the diaphragm inner ring and the diaphragm inner ring insertion portion of the nozzle blade are shaped to be fitted into each other only in one of circumferential direction and diameter direction of each of the groove and the diaphragm inner ring insertion portion.

In a preferred embodiment of the above aspect of the present invention, an upstream side surface of the diaphragm outer ring insertion portion, which is directed toward a flow of a fluid (steam), is formed in combination of a protruded hook portion and a stepped block portion provided to be continuous to the protruded hook portion, and the protruded hook portion and the stepped block portion extend in the circumferential direction.

In addition, the diaphragm inner ring insertion portion may have a convex columnar piece formed at an intermediate position, and the convex columnar piece may extend in the circumferential direction.

The diaphragm outer ring has a cap groove formed in the circumferential direction, the cap groove including a protruded hook portion at an inlet.

Further, the diaphragm inner ring may have a concave groove formed in the circumferential direction.

A fitting gap between the diaphragm outer ring insertion portion and the diaphragm outer ring is set in a range of 0.03 to 0.12 millimeters.

The fitting gap set in the range of 03 to 0.12 millimeters between the diaphragm outer ring insertion portion and the diaphragm outer ring is at least one of a gap between a surface on a head side of the diaphragm outer ring insertion portion parallel to a flow of a fluid and the diaphragm outer ring and a gap between a surface on an upstream side surface of the diaphragm outer ring insertion portion in the diameter direction and the diaphragm outer ring.

A fitting gap between the diaphragm inner ring insertion portion and the diaphragm inner ring is set in a range of 0.03 to 0.12 millimeters.

The fitting gap set in the range of 03 to 0.12 millimeters between the diaphragm inner ring insertion portion and the diaphragm inner ring is a gap between a surface of a columnar piece of the diaphragm inner ring insertion portion in the diameter direction and the diaphragm inner ring.

Moreover, the diaphragm outer ring insertion portion may be formed in combination of protruded hook portions provided on an upstream side surface directed toward a flow of a fluid and a downstream side surface along the flow of the fluid, respectively, stepped block portions provided to be continuous to the respective protruded hook portions, and protruded base portions provided to be continuous to the respective stepped block portions.

The diaphragm outer ring insertion portion is constituted in combination of a columnar piece directed toward the diameter direction and a protruded base portion provided to be continuous to the columnar piece.

An upstream side surface of the diaphragm outer ring insertion portion which surface is directed toward a flow of a fluid can be formed in combination of a protruded hook portion, a stepped block portion provided to be continuous to the hook portion, and a protruded base portion provided to be continuous to the block portion, a ring piece is attached to the block portion, and fixing means is provided on the diaphragm outer ring so as to apply a pressing force to the diaphragm outer ring insertion portion.

An upstream surface of the diaphragm outer ring insertion portion which is directed toward a flow of a fluid may be formed in combination of a protruded hook portion, a stepped block portion provided to be continuous to the hook portion, and a protruded base portion provided to be continuous to the block portion, and a shakiness prevention piece may be provided on a fitting surface on which the diaphragm outer ring insertion portion is fitted to the diaphragm outer ring.

This shakiness prevention piece is provided at least one of a gap between a surface on a head side of the diaphragm outer ring insertion portion parallel to the flow of the fluid and the diaphragm outer ring and a gap between a surface of the upstream side surface of the diaphragm outer ring insertion portion in the diameter direction and the diaphragm outer ring.

This shakiness prevention piece may be provided at a corner portion of the upstream side surface on a head side of the diaphragm outer ring insertion portion.

In addition, a plurality of the nozzle blades each supported by the diaphragm outer ring and the diaphragm inner ring may be arranged at counterflow positions along a flow of a fluid to be divided, and the plurality of nozzle blades arranged at the counterflow positions may be supported by the single diaphragm inner ring.

On the other hand, a plurality of the nozzle blades each supported by the diaphragm outer ring and the diaphragm inner ring may be arranged at counterflow positions along a flow of a fluid to be divided, and the diaphragm outer ring insertion portion of each of the plurality of nozzle blades arranged at the counterflow positions may be supported by the single diaphragm outer ring.

Furthermore, in another aspect of the present invention, the above-mentioned object can be also achieved by providing an assembled nozzle diaphragm comprising: a diaphragm outer ring having a groove opened toward an inner diameter side to be continuous in an inner peripheral direction of the diaphragm outer ring; a diaphragm inner ring having a groove opened toward an outer diameter side to be continuous in an outer peripheral direction of the diaphragm inner ring; and a nozzle blade having an insertion portion for the diaphragm outer ring provided on one end and having an insertion portion for the diaphragm inner ring provided on the other end, wherein the diaphragm inner ring includes a nozzle blade inner periphery-side member formed integrally with the nozzle blade.

This diaphragm outer ring may include a shakiness prevention piece on a fitting surface on which the diaphragm outer ring insertion portion is fitted to the diaphragm outer ring.

Moreover, the above-mentioned object can be also achieved by providing an assembled nozzle diaphragm comprising: a diaphragm outer ring having a groove opened toward an inner diameter side to be continuous in an inner peripheral direction of the diaphragm outer ring; and a nozzle blade having an insertion portion for the diaphragm outer ring provided on one end and a diaphragm inner ring provided on the other end, wherein a plate is inserted into the diaphragm inner ring.

Still furthermore, the above-mentioned object can be achieved by providing, in a further aspect, a method of assembling a nozzle diaphragm which comprises a diaphragm outer ring having a groove opened toward an inner diameter side to be continuous in an inner peripheral direction of the diaphragm outer ring, a diaphragm inner ring having a groove opened toward an outer diameter side to be continuous in an outer peripheral direction of the diaphragm inner ring, and a nozzle blade having an insertion portion for the diaphragm outer ring provided on one end and an insertion portion for the diaphragm inner ring provided on the other end, the method characterized by comprising the steps of: working the diaphragm outer ring to be divided in half to a diaphragm outer ring upper half portion and a diaphragm outer ring lower half portion at a horizontal joint surface position substantially at 180 degrees so as to constitute the diaphragm outer ring of a ring body; working the diaphragm inner ring to be divided in half to a diaphragm inner ring upper half portion and a diaphragm inner ring lower half portion at a horizontal joint surface position substantially at 180 degrees so as to constitute the diaphragm inner ring of the ring body; fitting the diaphragm outer ring insertion portion of the nozzle blade from a horizontal joint surface of one of the diaphragm outer ring upper half portion and the diaphragm outer ring lower half portion toward a horizontal joint surface of the other one of the diaphragm outer ring upper half portion and the diaphragm outer ring lower half portion so as to sequentially insert, one by one, the nozzle blades of a preset number in a circumferential direction; fixing the plurality of inserted nozzle blades by stopper pieces on the horizontal joint surfaces of the one half portion and on the horizontal joint surface of the other half portion, respectively; inserting the diaphragm inner ring upper half portion and the diaphragm inner ring lower half portion into the inner ring insertion portion of the nozzle blade from an inside diameter direction of the inner ring insertion portion; fixing the plurality of inserted nozzle blades by stopper pieces on the horizontal joint surface of the inserted diaphragm inner ring upper half portion and the horizontal joint surface of the inserted diaphragm inner ring lower half portion, respectively; and fixing the diaphragm inner ring upper half portion and the diaphragm outer ring upper half portion integrated with the nozzle blades of the preset number to the diaphragm inner ring lower half portion and the diaphragm outer ring lower half portion integrated with the nozzle blades of the preset number on the respective horizontal joint surfaces.

In this nozzle diaphragm assembling method, a fitting gap between the diaphragm outer ring insertion portion and the diaphragm outer ring is set in a range of 0.03 to 0.12 millimeters.

In addition, the fitting gap set in the range of 0.03 to 0.12 millimeters between the diaphragm outer ring insertion portion and the diaphragm outer ring is at least one of a gap between a surface on a head side of the diaphragm outer ring insertion portion parallel to a flow of a fluid and the diaphragm outer ring and a gap between a surface on an upstream side surface of the diaphragm outer ring insertion portion in the diameter direction and the diaphragm outer ring.

Further, a fitting gap between the diaphragm inner ring insertion portion and the diaphragm inner ring is set in a range of 0.03 to 0.12 millimeters.

The fitting gap set in the range of 0.03 to 0.12 millimeters between the diaphragm inner ring insertion portion and the diaphragm inner ring exists in the diameter direction of a columnar piece of the diaphragm inner ring insertion portion.

The assembled nozzle diaphragm according to the present invention having the characteristic features mentioned above can utilize the simple assembly structure in which the diaphragm outer ring insertion portion provided on one end of the nozzle blade is fitted to the diaphragm outer ring and in which the diaphragm inner ring insertion portion provided on the other end of the nozzle blade is fitted to the diaphragm inner ring. Therefore, at the time when the assembled nozzle diaphragm according to the present invention is applied to, for example, the steam turbine, the path width of the steam path can be kept exactly at the designed dimension and the turbine nozzle can be operated with far higher turbine stage efficiency.

In addition, with the nozzle diaphragm assembling method according to the present invention, the nozzle blade can be freely moved relative to the diaphragm inner and outer rings. Therefore, even if a damage such as a crack occurs to the nozzle blade during the operation of the steam turbine, it suffices to exchange only the nozzle blade to which the damage or the like occurs. Thus, differently from the conventional art, it is unnecessary to exchange the entire diaphragm and it is therefore possible to further reduce exchange operation.

BEST MODE FOR CARRYING OUT THE INVENTION

Figure 1:
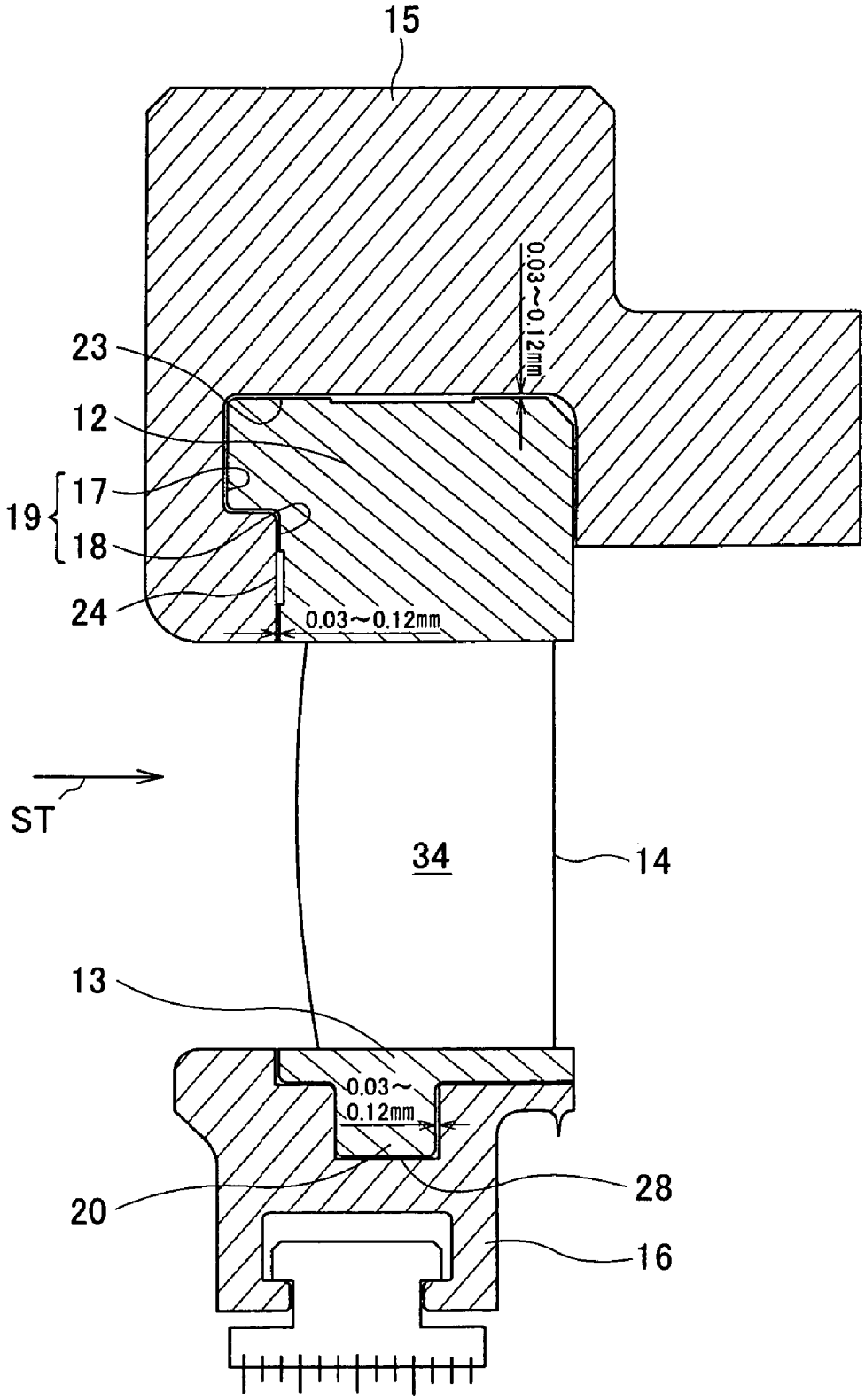
FIG. 1 is a sectional view which illustrates a first embodiment of an assembled nozzle diaphragm according to the present invention.

The embodiments of an assembled nozzle diaphragm and an assembling method thereof according to the present invention will be described hereunder with reference to the accompanying drawings by way of reference numerals added to the drawings. In the respective embodiments, the assembled nozzle diaphragm is applied to a steam turbine. Reference numeral ST in the drawings denotes a steam flow in the steam turbine.

Figure 31:
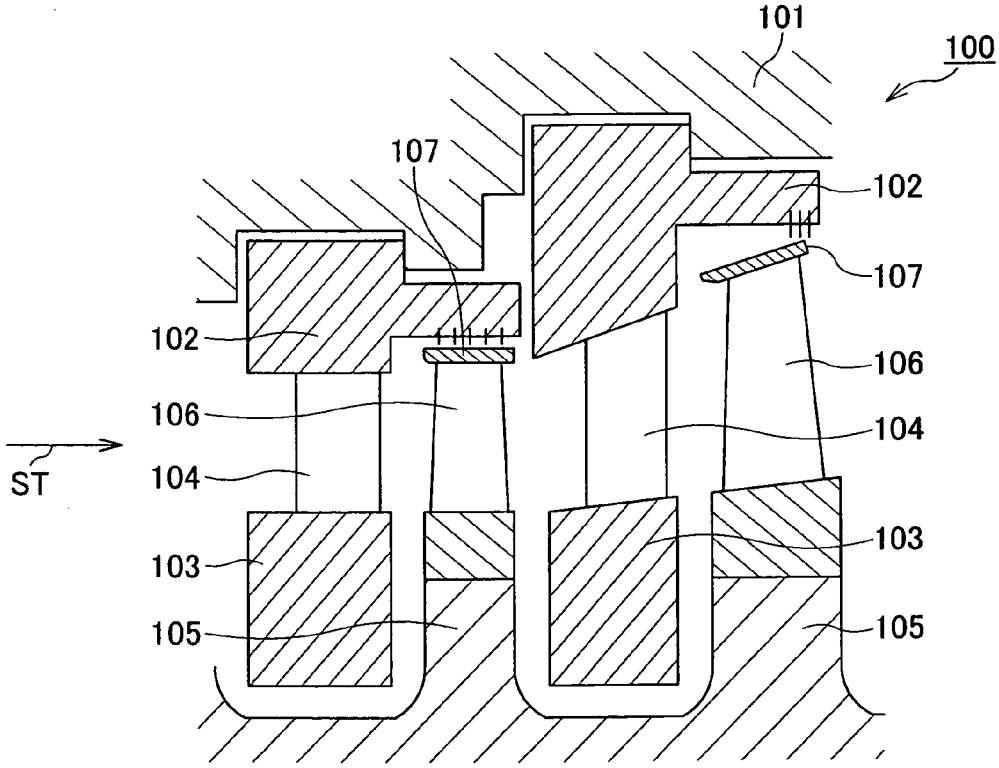
FIG. 31 is a schematic longitudinal sectional view of an axial flow turbine provided with the assembled nozzle diaphragm.

FIG. 31 illustrates stages of an axial flow steam turbine 100 that provided with the assembled nozzle diaphragm. Each nozzle blade 104 is attached to a diaphragm outer ring 102 attached to a turbine casing 101 and a diaphragm inner ring 103 so as to form a nozzle blade flow path. A plurality of turbine moving (rotor) blades 106 is arranged downstream of this nozzle blade flow path. The moving blades 106 are built up or assembled in columns at predetermined intervals on an outer periphery of a rotor wheel 105 in a circumferential direction, and a cover 107 that prevents leakage of a working fluid is attached to an outer peripheral end of each moving blade 106.

In FIG. 31, the fluid, that is, steam ST flows from a right direction (upstream side) of the steam turbine to a left direction (downstream side) thereof. Further, it is to be noted that, in the respective embodiments, at the time when the assembled nozzle diaphragm according to the present invention is applied to the steam turbine, the constituent elements of the assembled nozzle diaphragm are provided at positions shown in FIG. 31 even without so specified.

FIG. 1 is an elevational section which illustrates the first embodiment of the assembled nozzle diaphragm according to the present invention.

The assembled nozzle diaphragm in this embodiment is constituted so that a nozzle blade (nozzle plate) 14 that includes a diaphragm outer ring insertion portion 12 and a diaphragm inner ring insertion portion 13 on both ends, respectively, a diaphragm outer ring 15 to which the diaphragm outer ring insertion portion 12 is fitted and which supports a head of the nozzle blade (nozzle plate) 14, and a diaphragm inner ring 16 to which the diaphragm inner ring insertion portion 13 is fitted and which supports a bottom of the nozzle blade (nozzle plate) 14.

Figure 2:
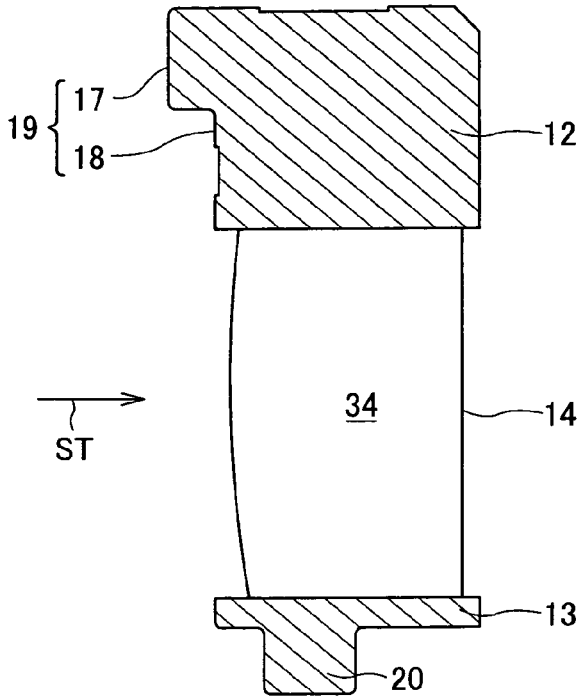
FIG. 2 illustrates a nozzle blade pulled out from a diaphragm outer ring and a diaphragm inner ring shown in FIG. 1.
Figure 3:
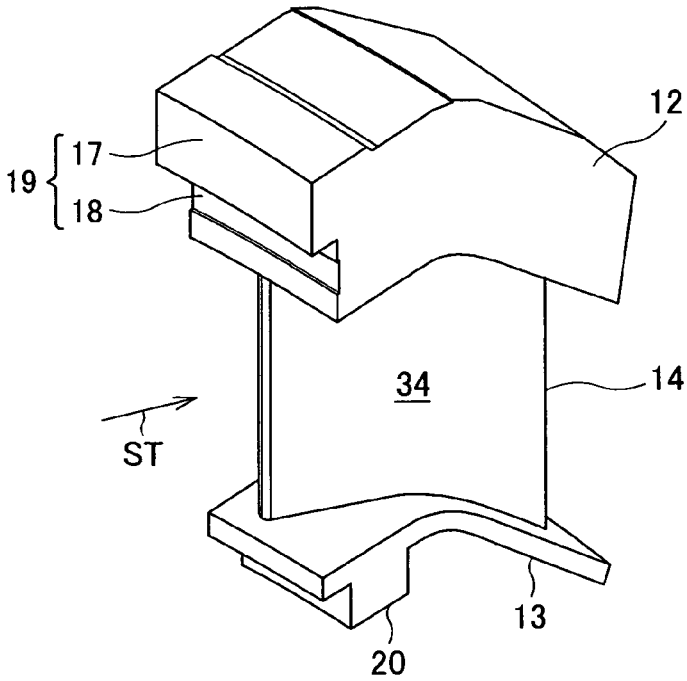
FIG. 3 is a perspective view of the nozzle blade shown in FIG. 2 from an inclined direction of a front edge of the nozzle blade.

As shown in FIGS. 2 and 3, the diaphragm outer ring insertion portion 12 is formed together with the nozzle blade 14 by precision casting or by being integrally cut out from a nozzle blade element assembly through a machining process. An upstream side surface portion 19 of the nozzle outer ring insertion portion 12 directed toward a flow of the steam ST in a case where this assembled nozzle diaphragm is incorporated to the steam turbine is formed to be protruded as a whole. This upstream side surface portion 19 is formed as a ring block body including a hook portion 17 and a block portion 18 formed in a step form, and the upstream side surface portion 19 extends in the circumferential direction (a moving blade rotating direction on a perpendicular plane relative to the steam flow).

Further, the diaphragm inner ring insertion portion 13, similarly to the diaphragm outer ring insertion portion 12 shown in FIGS. 2 and 3, is formed together with the nozzle blade 14 by precision forging or by being integrally cut out from the nozzle blade element assembly by the machining work. The diaphragm inner ring insertion portion 13 includes a convex columnar piece 20 in an intermediate portion and this columnar piece 20 is formed into a ring block body extending in the circumferential direction.

Figure 4:
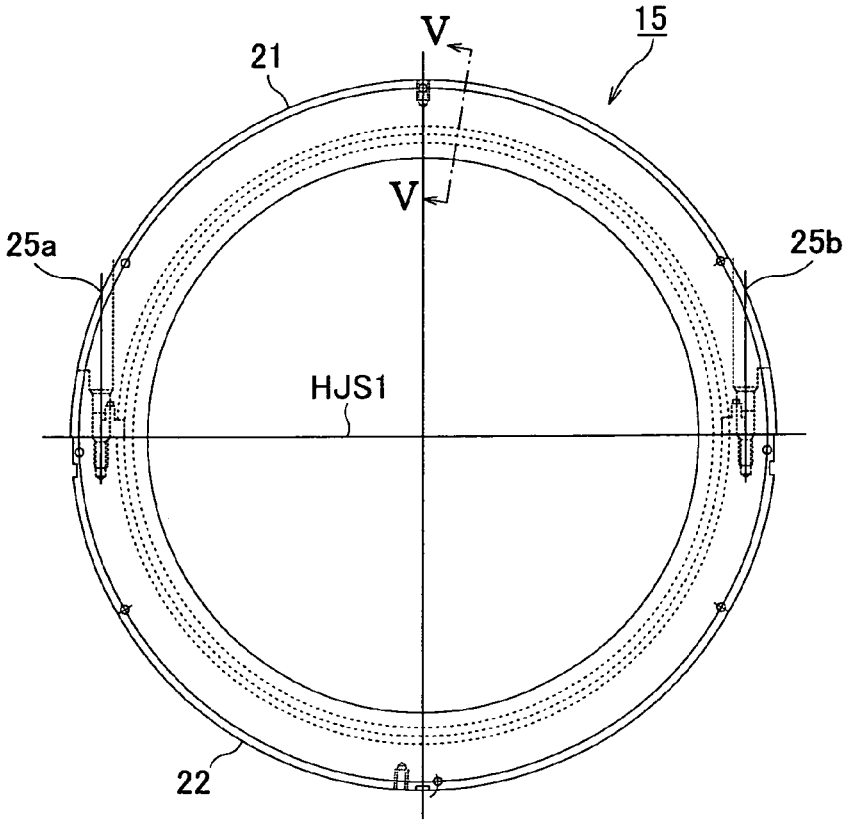
FIG. 4 illustrates the diaphragm outer ring pulled out from the nozzle blade shown in FIG. 1.
Figure 5:
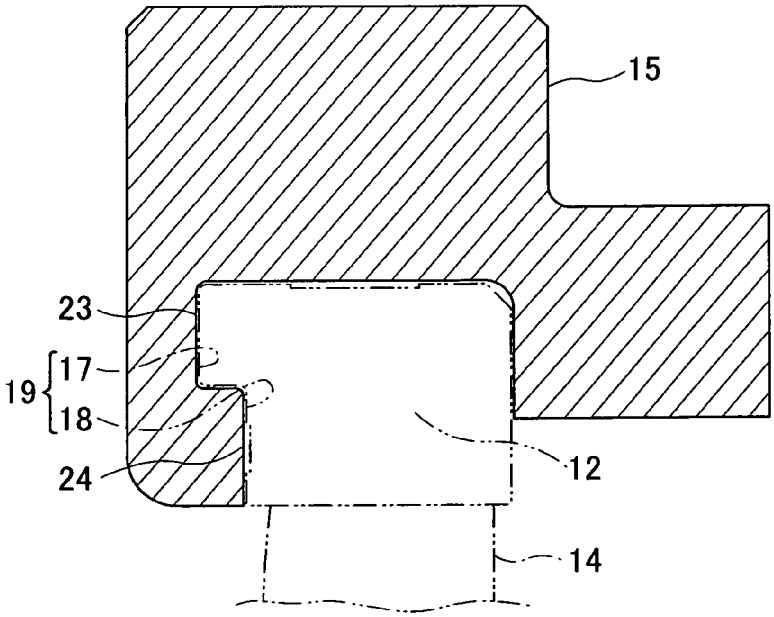
FIG. 5 is a cross-sectional view taken along a line V—V shown in FIG. 4.

As shown in FIG. 4, the diaphragm outer ring 15, to which the diaphragm outer ring insertion portion 12 is fitted, is formed as a ring body and divided in half to an outer ring upper half portion 21 and an outer ring lower half portion 22 on a horizontal joint surface HJS1. The diaphragm outer ring 15 divided in half includes a protruded hook portion 24 at an inlet of a cap or cap-shaped groove 23, and this hook portion 24 applies a pressing force to the stepped block portion 18 of the diaphragm outer ring insertion portion 12 and engages with and supports the hook portion 17 of the diaphragm outer ring insertion portion 12.

Namely, the presence of the cap-shaped groove 23 and the hook portion 24 of the diaphragm outer ring 15 enables the diaphragm outer ring insertion portion 12 of the nozzle blade 14 to be fitted and inserted into the diaphragm outer ring 15 only on the horizontal joint surface HJS1 while the nozzle blade 14 cannot be inserted into the diaphragm outer ring 15 in the other regions.

When the diaphragm outer ring insertion portion 12 is successively fitted to the cap-shaped groove 23 formed in the diaphragm outer ring 15 and the diaphragm outer ring insertion portion 12 is arranged on an entire periphery of the diaphragm outer ring 15, the outer ring upper half portion 21 and the outer ring lower half portion 22 of the diaphragm outer ring 15 are then fastened by means of bolts 25*a* and 25*b* as shown in FIG. 4. The diaphragm outer ring 15 is engaged with and supported by a casing (not shown).

Figure 6:
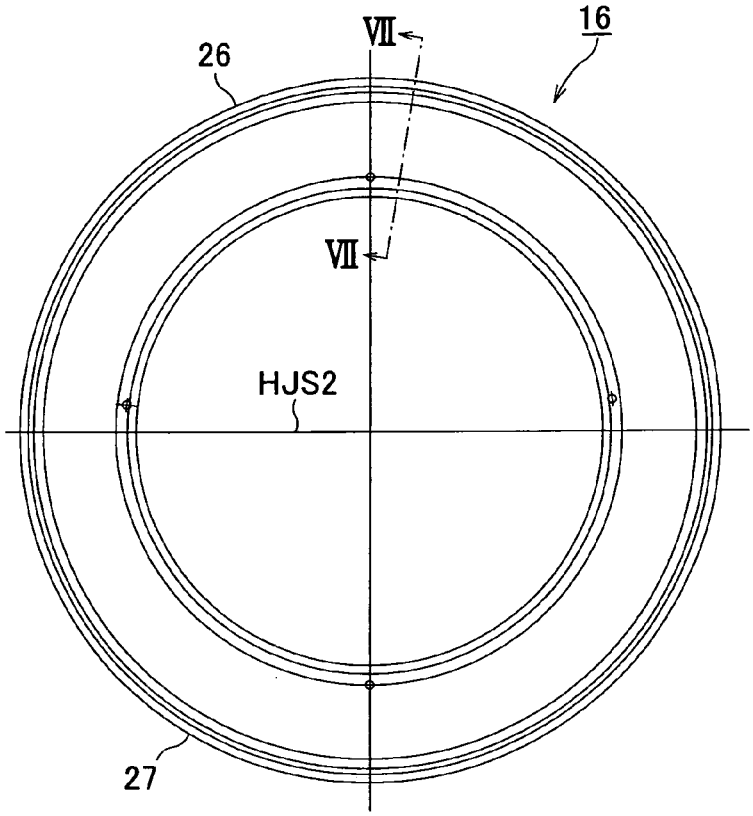
FIG. 6 illustrates the diaphragm inner ring pulled out from the nozzle blade shown in FIG. 1.
Figure 7:
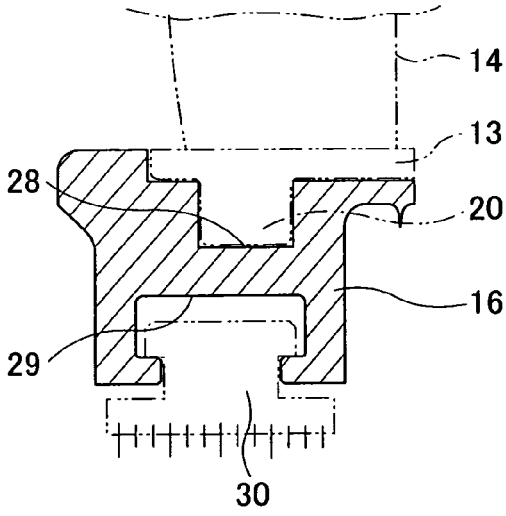
FIG. 7 is a cross-sectional view taken along a line VII—VII shown in FIG. 6.

As shown in FIG. 6, the diaphragm inner ring 16, to which the diaphragm inner ring insertion portion 13 is fitted, is formed as a ring body and divided in half to an inner ring upper half portion 26 and an inner ring lower half portion 27 on a horizontal joint surface HJS2 similarly to the diaphragm outer ring 15. As shown in FIG. 7, the diaphragm inner ring 16 divided in half includes a concave groove 28 on a head side (outer diameter side) and a labyrinth packing groove 29 on a bottom side (inner diameter side). The diaphragm inner ring insertion portion 13 is fitted to the concave groove 28 on the head side, a labyrinth packing 30 is fitted into the labyrinth packing groove 29, and then the inner ring upper half portion 26 and the inner ring lower half portion 27 are joined together by a key (not shown) as shown in FIG. 6.

Namely, the assembled nozzle diaphragm has a structure in which the diaphragm inner ring insertion portion 13 of the nozzle blade 14 is fitted to the diaphragm inner ring 16 through the engagement of the simple concave groove 28 and the simple convex columnar piece 20. Therefore, it is unnecessary to move the diaphragm inner ring 16 from the horizontal joint surface HJS2 in the circumferential direction so as to successively insert the diaphragm inner ring insertion portion 13 of the nozzle blade 14 into the diaphragm inner ring 16, and the diaphragm inner ring insertion portion 13 can be simply inserted thereinto from an inside diameter direction (from a downward direction to an upward direction in FIG. 7).

Figure 9:
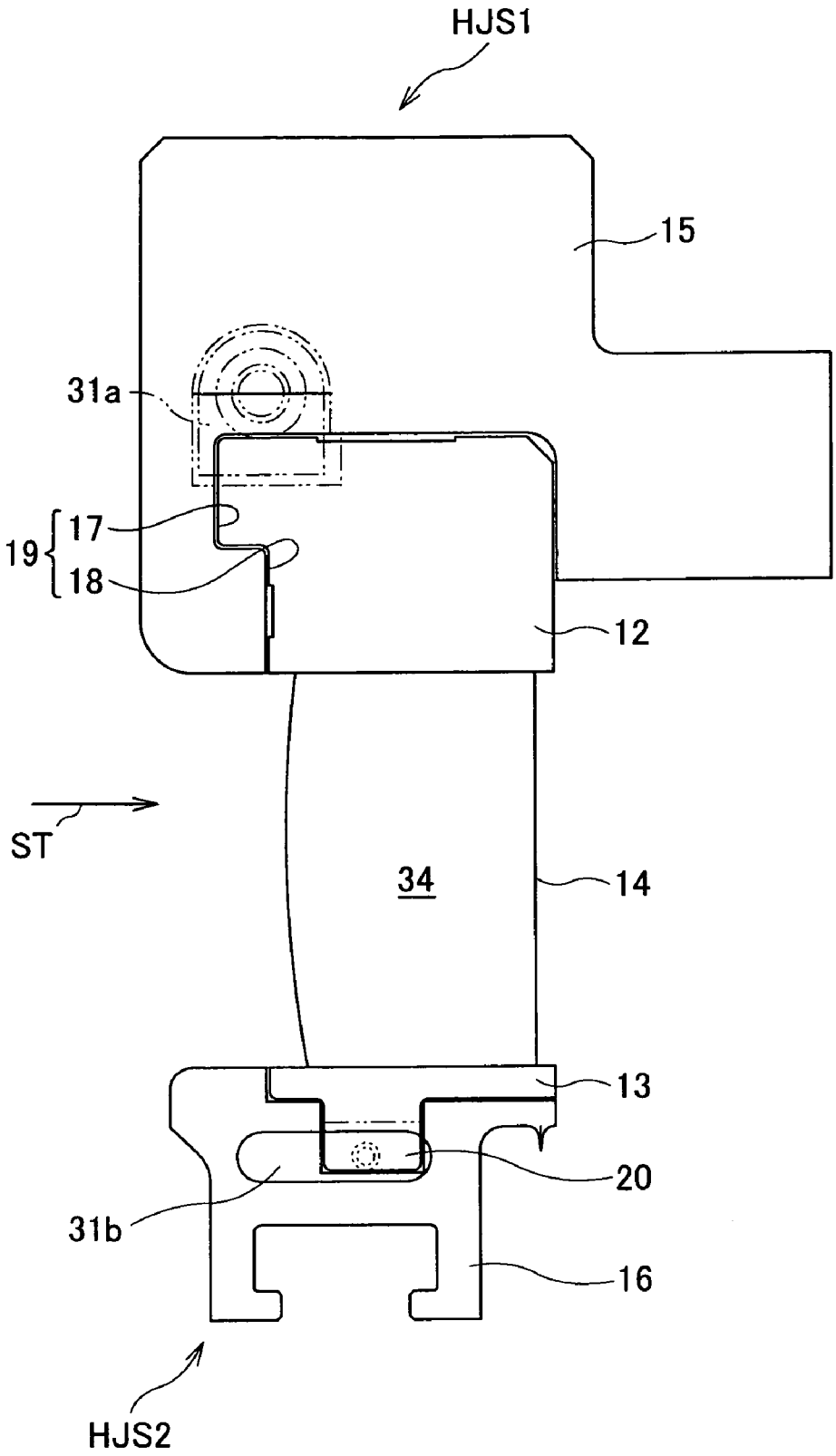
FIG. 9 illustrates a horizontal joint surface of the diaphragm outer ring and that of the diaphragm inner ring.
Figure 10:
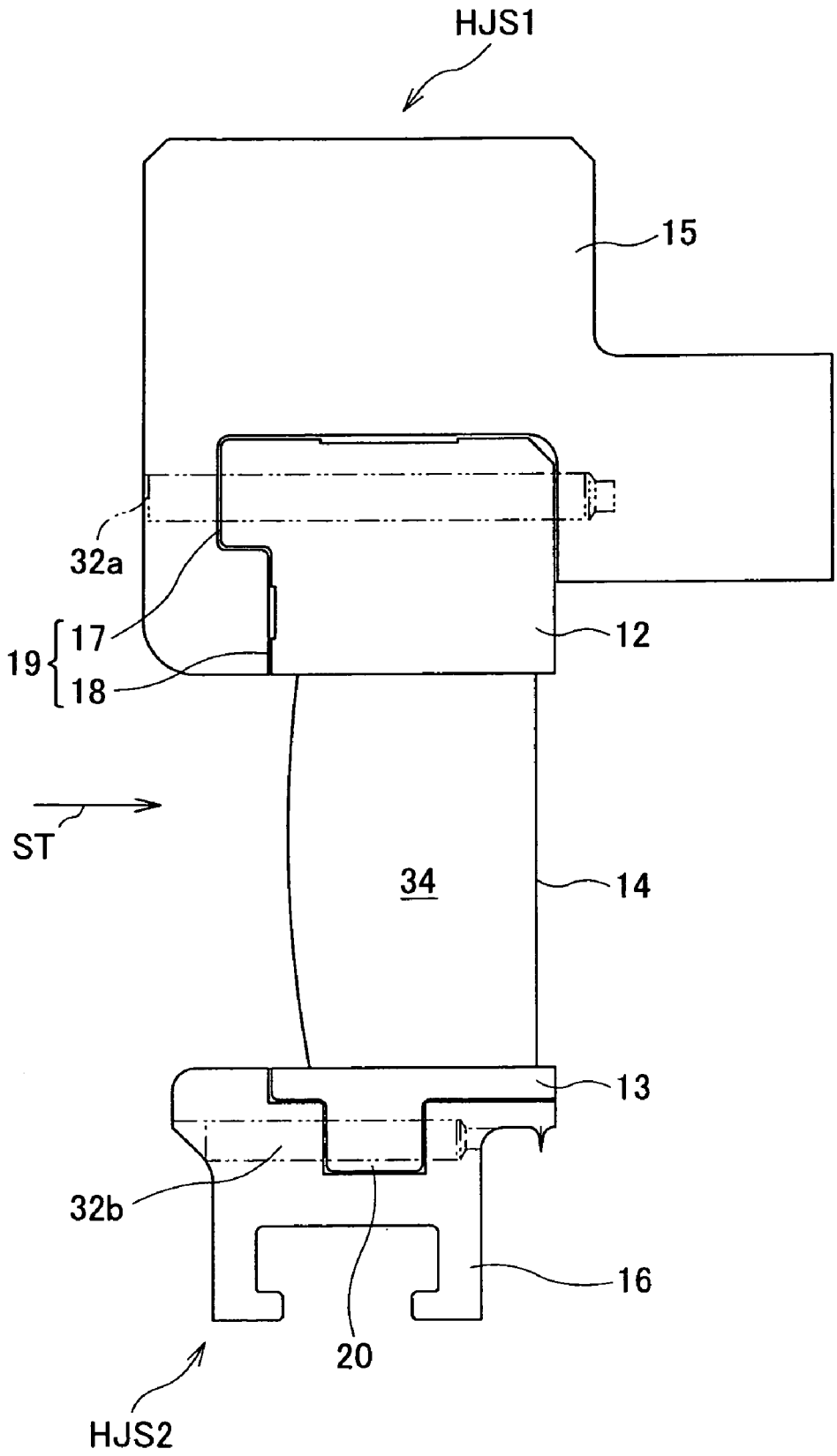
FIG. 10 illustrates a modified example of the horizontal joint surface of the diaphragm outer ring and that of the diaphragm inner ring.

In addition, after the diaphragm outer ring insertion portion 12 and the diaphragm inner ring insertion portion 13 are fitted into the diaphragm outer ring 15 and the diaphragm inner ring 16, respectively, stopper pieces 31*a* and 31*b* are mounted to the diaphragm outer ring 15 and the diaphragm outer ring insertion portion 12 and also to the diaphragm inner ring 16 and the diaphragm inner ring insertion portion 16 on the horizontal joint surfaces HJS1 and HJS2, respectively, shown in FIG. 9, whereby the outer and inner ring upper half portions 21 and 26 and the outer and inner ring lower half portions 22 and 27 of the diaphragm outer ring 15 and the diaphragm inner ring 16 both divided in half are fixedly attached to each other, respectively. The fixing of the diaphragm outer ring insertion portion 12 to the diaphragm outer ring 15 and that of the diaphragm inner ring insertion portion 13 to the diaphragm inner ring 16 may be made by, for example, using fastening members 32*a* and 32*b*, respectively, as shown in FIG. 10.

Figure 8:
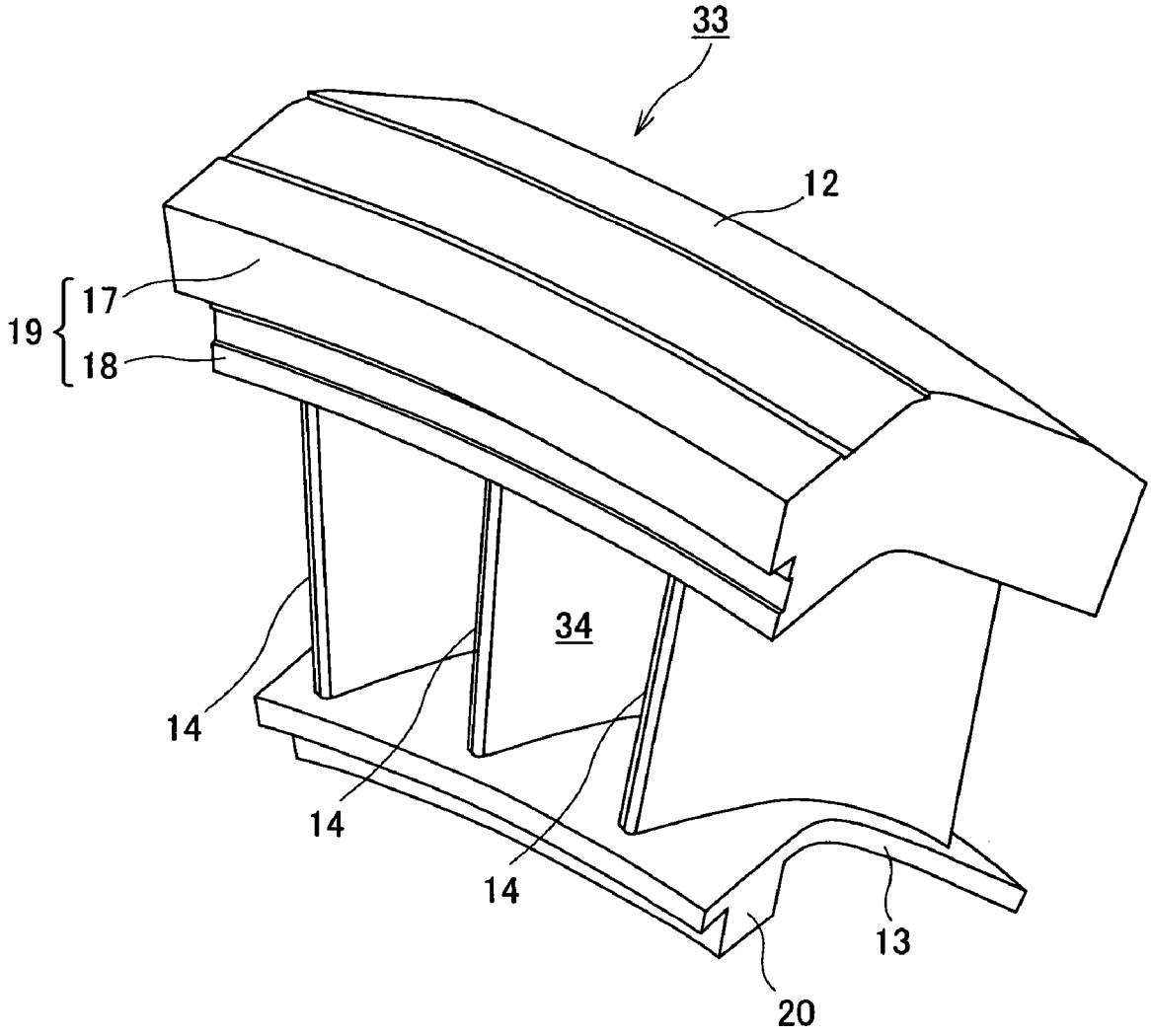
FIG. 8 is a perspective view illustrating a state that a plurality of nozzle blades are bound together.

In this embodiment, the fitting of the diaphragm outer ring insertion portion 12 into the diaphragm outer ring 15 and that of the diaphragm inner ring insertion portion 13 into the diaphragm inner ring 16 are made for each nozzle blade 14. However, the present invention is not limited to this embodiment. As shown in, for example, FIG. 8, it may be possible to provide a nozzle diaphragm block body 33 that binds together a plurality of nozzle blades 14 such as three nozzle blades and allows the nozzle blades 14 to be supported by the diaphragm outer ring 15 and the diaphragm inner ring 16.

In the case where the diaphragm outer ring insertion portion 12 is fitted to the diaphragm outer ring 15, it is most preferable to set the fitting dimension of the diaphragm outer ring insertion portion 12 fitted to the diaphragm outer ring 15 to be in a range in which a gap of 0.03 to 0.12 millimeters is formed along a surface of the head side of the diaphragm outer ring insertion portion 12 in the flow direction of the steam ST, and a gap of 0.03 to 0.12 millimeters is formed in a surface of the stepped block portion 18 on a diameter direction side (a side orthogonal to the flow direction of the steam ST) as shown in FIG. 1.

On the other hand, in the case where the diaphragm inner ring insertion portion 13 is fitted to the diaphragm inner ring 16, it is most preferable to set the fitting dimension of the diaphragm inner ring insertion portion 13 fitted to the diaphragm inner ring 16 to be in a range in which a gap of 0.03 to 0.12 millimeters is formed on the diameter direction side (side orthogonal to the flow direction of the steam ST) of the columnar piece 20 of the diaphragm inner ring insertion portion 13 as shown in FIG. 1.

The setting of each of the fitting dimensions of the diaphragm outer ring insertion portion 12 fitted to the diaphragm outer ring 15 and that of the diaphragm inner ring insertion portion 13 fitted to the diaphragm inner ring 16 to be in the range of 0.03 to 0.12 millimeters is based on the fact that if they are set to be 0.03 millimeters or less, the diaphragm outer and inner ring insertion portions 12 and 13 cannot be assembled manually with the diaphragm outer and inner rings 15 and 16 and that if they exceed 0.12 millimeters, plays are generated and a shakiness occurs to the assembled nozzle diaphragm during the operation. An FEM (finite element method) analysis, a mock-up test or the like also has confirmed that these fitting dimensions are the most appropriate dimensions.

As is apparent from the above, according to this embodiment, the diaphragm outer ring insertion portion 12 is provided on one end of the nozzle blade (nozzle plate) 14, the diaphragm inner ring insertion portion 13 is provided on the other end thereof, the groove 23, to which the diaphragm outer ring insertion portion 12 is fitted, is provided in the diaphragm outer ring 15, and the groove 28, to which the diaphragm inner ring insertion portion 13 is fitted, is provided in the diaphragm inner ring 16, whereby there can be provided the simple assembled structure that does not require welding operation for welding the diaphragm outer ring insertion portion 12 and the diaphragm inner ring insertion portion 13 to the respective grooves 23 and 28. Therefore, during the assembly of the turbine nozzle, a steam path 34 can be kept to have designed dimensions and the turbine nozzle can be operated with an improved turbine stage efficiency at low cost that does not accompany the welding cost.

The assembling method of the nozzle diaphragm according to the present invention will be then described hereunder.

Figure 21:
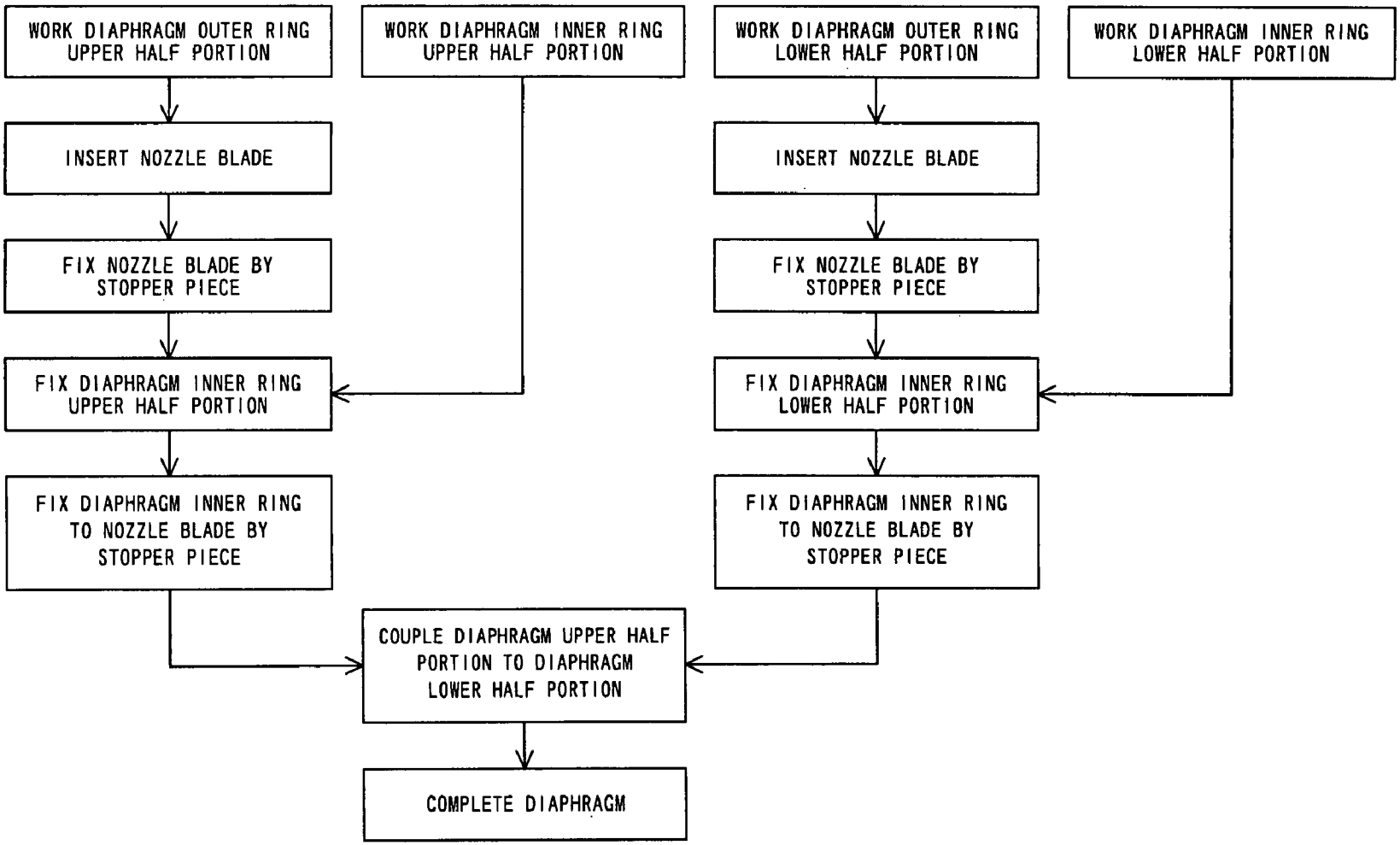
FIG. 21 is a flow chart which illustrates the steps of assembling procedures of the assembled nozzle diaphragm according to the first to second embodiments of the present invention.

FIG. 21 is a schematic block diagram showing the steps of the method of assembling the nozzle diaphragm according to the present invention.

The diaphragm outer ring 15 and the diaphragm inner ring 16, which are ring bodies when the nozzle diaphragm is completed, are manufactured independently as the diaphragm outer ring upper half portion 21 and the diaphragm outer ring lower half portion 22 obtained by dividing the diaphragm outer ring 15 in half at a position of substantially 180 degrees and as the diaphragm inner ring upper half portion 26 and the diaphragm inner ring lower half portion 27 obtained by dividing the diaphragm inner ring 16 in half at a position of substantially 180 degrees, respectively. The grooves into which the nozzle blade 14 is fitted are preliminarily worked in the upper half portions 21 and 26 and the lower half portions 22 and 27. That is, the cap-shaped groove 23 and the hook portion 24 are worked in the diaphragm outer ring upper half portion 21 and the diaphragm outer ring lower half portion 22, respectively, whereas the concave groove 28 is worked in the diaphragm inner ring upper half portion 26 and the diaphragm inner ring lower half portion 27. Shapes of these grooves are set in advance so that the diaphragm outer ring insertion portion 12 and the nozzle blade 14 are surely engaged with the respective grooves.

Next, the nozzle blades 14 are sequentially inserted into the worked cap-shaped groove 23 and hook portion 24 from one side of the horizontal joint surface HSJ1. The number of nozzle blades 14 to be inserted is determined in advance based on a pitch circle diameter (PCD) of this diaphragm and a pitch between the nozzle blades 14.

Among the inserted nozzle blades 14, the first and last inserted nozzle blades 14, i.e., the two nozzle blades 14 facing the horizontal joint surface HSJ1 of the diaphragm outer ring 15 are fixed relative to the circumferential direction so that the nozzle blades 14 do not slip off from the grooves of the outer rings by means of the stopper pieces 31*a* fixed to the diaphragm outer rings 15. Therefore, the inserted nozzle blades 14 are fixed relative to the steam flow direction and a nozzle blade longitudinal direction by engaging the hook portions 17 of the diaphragm outer ring insertion portions 12 provided on these nozzle blades 14 with the cap-shaped grooves 23 of the diaphragm outer rings 15 and also engaging the block portions 18 of the diaphragm outer ring insertion portions 12 provided on the nozzle blades 14 with the hook portions 24 of the diaphragm outer rings 15, respectively. Thus, it is not particularly necessary to employ mechanical means such as bolts or pins or fixing means such as welding for fitting the diaphragm outer ring insertion portions 12 of the nozzle blades 14 into the respective diaphragm outer rings 15. On the other hand, in the circumferential direction, there is provided only means for preventing the nozzle blades 14 from slipping off from the respective grooves by the stopper pieces 31*a* provided on the horizontal joint surface HSJ1, and the nozzle blades 14 are fixed to the grooves by contacting the adjacent blades with one another in the circumferential direction. The experiment and the FEM analysis have confirmed that the gap of a portion, in which each diaphragm outer ring insertion portion 12 provided on the nozzle blade 14 is fitted into the diaphragm outer ring 15, is optimally in the range of 0.03 to 0.12 millimeters in view of easiness of assembling, vibrations generated by the steam after assembly and the like.

In the next step, the diaphragm inner ring 16 is fitted into the diaphragm outer ring 15, to which each nozzle blade 14 is inserted, from the diaphragm inner ring insertion portion side of the nozzle blade 14. The fitting portion has a simple shape consisting of the concave groove 28 provided in the diaphragm inner ring 16 and the convex columnar piece 20 provided on the diaphragm inner ring insertion portion 13 of the nozzle blade 14. Because of this reason, it is unnecessary to take a step for sequentially inserting the nozzle blades 14 into the diaphragm outer rings 15 from the horizontal joint surface HJS1, but it suffices to simply fit the diaphragm inner ring 16 into the diaphragm outer ring 15 from the diaphragm inner ring insertion portion side of the nozzle blade 14. The experiment and the FEM analysis have confirmed that the gap of the portion, in which the diaphragm inner ring insertion portion 13 provided on this nozzle blade 14 is fitted into each diaphragm inner ring 16, is optimally set to be in the range of 0.03 to 0.12 millimeters in view of the assembling facilitation, the vibration generated by the steam after the assembly and the like.

Next, each of the diaphragm inner ring 16 is fixed to the nozzle blade 14 by the stopper piece 31*b* in a manner such that the stopper piece 31*b* fixes the nozzle blade 14 relative to the circumferential direction and fixes the diaphragm inner ring insertion portion 13 of the nozzle blade 14 to the diaphragm inner ring 16 to thereby prevents the diaphragm inner ring 16 from slipping off.

Finally, the diaphragm upper half portion (or diaphragm lower half portion), in which the diaphragm outer ring 15, the nozzle blade 14 and the diaphragm inner ring 16 are formed integrally, and the diaphragm lower half portion (or diaphragm upper half portion) formed similarly are mated to each other on their horizontal joint surfaces, and then, the nozzle diaphragm is completed by screw-engaging a bolt with a bolt hole provided in the diaphragm outer ring 15 of one of the diaphragm upper and lower half portions and a thread portion provided in the other one of the diaphragm upper and lower half portion.

According to the assembling method of the characters mentioned above, since the nozzle blade 14 is not fixed to the diaphragm inner ring 16 and the diaphragm outer ring 15, even if any defect occurs to the nozzle blade during the operation, only the nozzle blade to which the defect occurs can be exchanged without exchanging the entire diaphragm as in the conventional art.

Furthermore, since the fitting gap between the nozzle blade 14 and the diaphragm inner ring 16 and that between the nozzle blade 14 and the diaphragm outer ring 15 are set to be in the range of 0.03 to 0.12 millimeters, no problem occurs to the nozzle blade insertion operation and the nozzle diaphragm can be operated without shakiness and with no mechanical fixing means even if a vibration is generated by the steam during the turbine operation.

Figure 11:
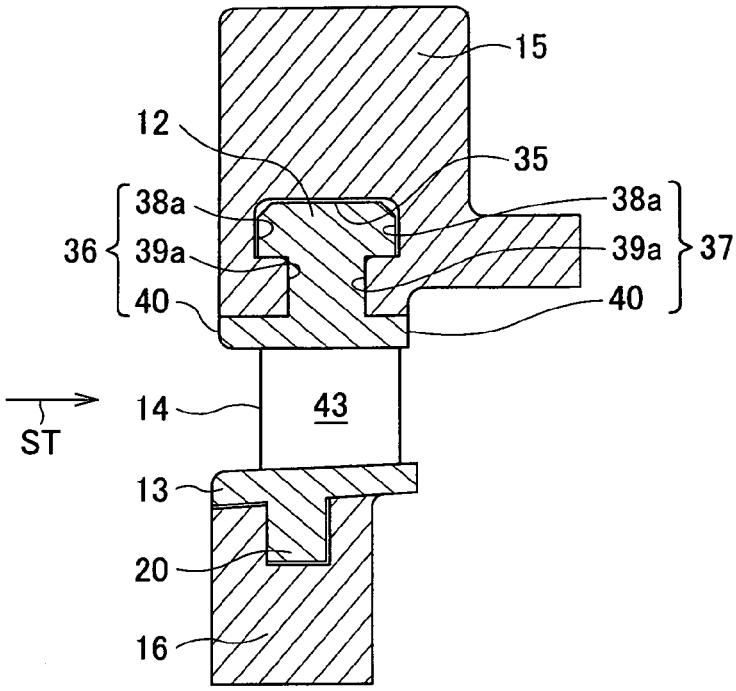
FIG. 11 is a sectional view illustrating a second embodiment of the assembled nozzle diaphragm according to the present invention.

FIG. 11 is an elevational section representing the second embodiment of the assembled nozzle diaphragm according to the present invention. In FIG. 11, like reference numerals are added to constituent elements corresponding to those in the first embodiment.

In the assembled nozzle diaphragm in this second embodiment, a T-shaped groove 35 is formed in the diaphragm outer ring 15, and the diaphragm outer ring insertion portion 12 fitted into this groove 35 is provided with protruded hook portions 38*a* and 38*b* formed on an upstream side surface 36 directed toward the flow of the steam ST and on a downstream side 37 directed toward the flow of the steam ST, respectively, stepped block portions 39*a* and 39*b* continuous to the respective hook portions, and base portions 40 continuous to the respective block portions.

These continuous hook portions 38*a* and 38*b*, block portions 39*a* and 39*b*, and base portions 40 are all formed together with the nozzle blade 14 by precision forging or by being integrally cut out from a nozzle blade element assembly by the machining work and formed so as to extend in the circumferential direction (moving blade rotating direction on the perpendicular plane relative to the steam flow). Since the other constituent elements are the same as those in the first embodiment, the descriptions thereof are omitted herein.

As is apparent from the above, according to the this second embodiment, the T-shaped cap groove 35 is formed in the diaphragm outer ring 15, the upstream side surface 36 and the downstream side surface 37 of the diaphragm outer ring insertion portion 12 are also formed by the continuous hook portions 38*a* and 38*b*, the block portions 39*a* and 39*b* and the base portions 40, respectively, and the hook portions 38*a* and 38*b* and the block portions 39*a* and 39*b* of the diaphragm outer ring insertion portion 12 are fitted into the groove 35 of the diaphragm outer ring 15, thus providing the simple assembled structure that does <not require welding operation. Therefore, during the assembling of the turbine nozzle, a steam path 43 can be kept to have designed dimensions and the turbine nozzle can be operated with highly improved turbine stage efficiency at low cost that does not accompany the welding cost.

In this embodiment, the so-called I-shaped diaphragm outer ring insertion portion 12 having the protruded hook portions 38*a* and 38*b*, the stepped block portions 39*a* and

Figure 12:
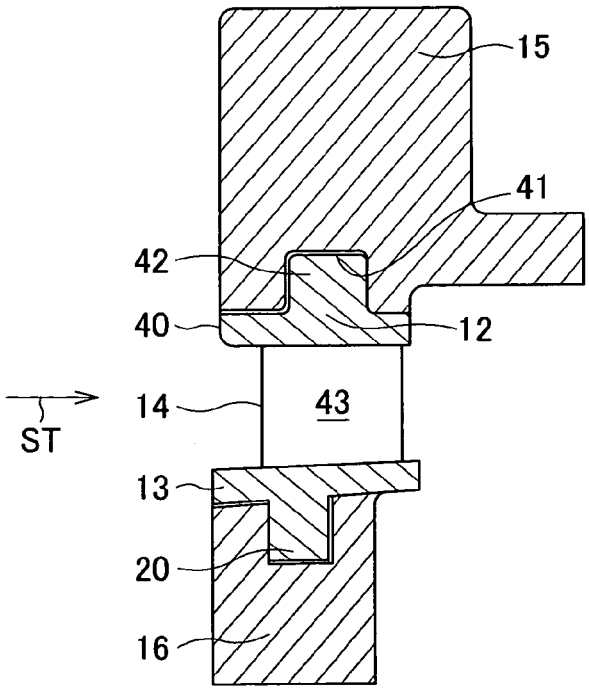
FIG. 12 is a sectional view illustrating a third embodiment of the assembled nozzle diaphragm according to the present invention.

39*b*, and the protruded base portions 40 formed on the upstream side surface 36 and the downstream side surface 37, respectively, is fitted into the T-shaped cap groove 35 formed in the diaphragm outer ring 15. However, the present invention is not limited to this embodiment, and as shown in, for example, FIG. 12 (the third embodiment), the diaphragm outer ring insertion portion 12 formed by a columnar piece 42 and a protruded base portion 40 directed toward a diameter direction (a direction orthogonal to the flow of the steam ST) may be formed in a concave groove 41 formed in the diaphragm outer ring 15 and directed toward the diameter direction.

Further, the assembling steps of the nozzle diaphragm assembling method in the second embodiment are substantially the same as those in the first embodiment, so that the steps will not be described herein.

Figure 13:
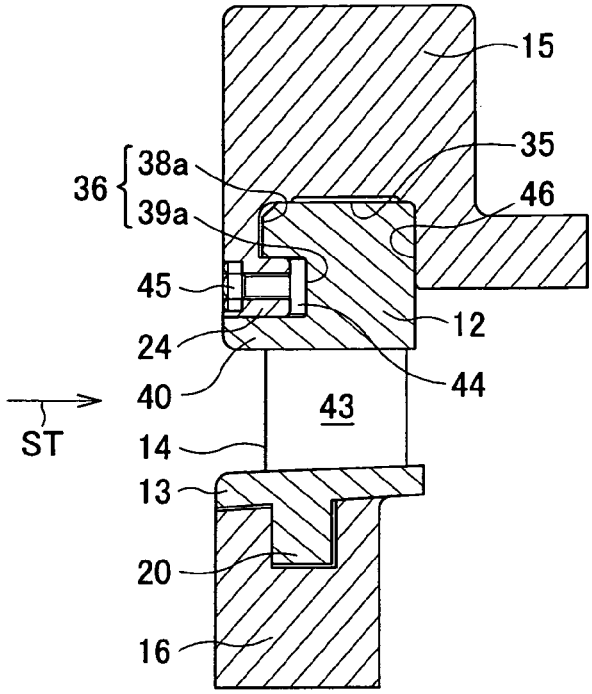
FIG. 13 is a sectional view illustrating a fourth embodiment of the assembled nozzle diaphragm according to the present invention.

FIG. 13 is an elevational section representing the fourth embodiment of the assembled nozzle diaphragm according to the present invention. In FIG. 13, the same constituent elements as those in the second embodiment are denoted by the same reference numerals.

In the assembled nozzle diaphragm in this embodiment, a cap or cap-shaped groove 35 provided with a protruded hook portion 24 on an inlet side is formed in the diaphragm outer ring 15. The upstream side surface 36 of the diaphragm outer ring insertion portion 13 which is directed toward the flow of the steam ST is also formed in combination of the protruded hook portion 38*a*, the stepped block portion 39*a* and the protruded base portion 40, and a ring piece 44 to be divided is attached to the block portion 39*a*. A bolt 45 is also provided on the diaphragm outer ring 15 to apply a pressing force to the diaphragm outer ring insertion portion 12, and a coupled surface on which the diaphragm outer ring insertion portion 12*m* to be fitted to the groove 35, is coupled to the diaphragm outer ring 15 is sealed. The other structures are substantially the same as those of the first embodiment, so that the details thereof are now omitted herein.

Further, the continuous hook portion 38*a*, block portion 39*a*, and base portion 40 are all formed together with the nozzle blade 14 by precision forging or by being integrally cut out from a nozzle blade element assembly by the machining work.

As is apparent from the above, in this fourth embodiment, at the time when the diaphragm outer ring insertion portion 12 is fitted and inserted into the diaphragm outer ring 15, the ring piece 44 is then interposed between the diaphragm outer ring insertion portion 12 and the diaphragm outer ring 15, and the coupled surface 46 between the diaphragm outer ring insertion portion 12 and the diaphragm outer ring 15 is sealed due to the pressing force of the bolt 45 engaged with the diaphragm outer ring 15. Therefore, the shakiness of the turbine nozzle can be surely prevented from causing and the turbine nozzle can be hence operated stably.

Further, in this embodiment, by utilizing the pressing force of the bolt 45, the coupled surface between the diaphragm outer ring insertion portion 12 and the diaphragm outer ring 15 is sealed. Therefore, it is not necessary to improve or maintain the accuracy of the fitting gap between the diaphragm outer ring insertion portion 12 and the diaphragm outer ring 15, thus reducing the working cost.

Figure 22:
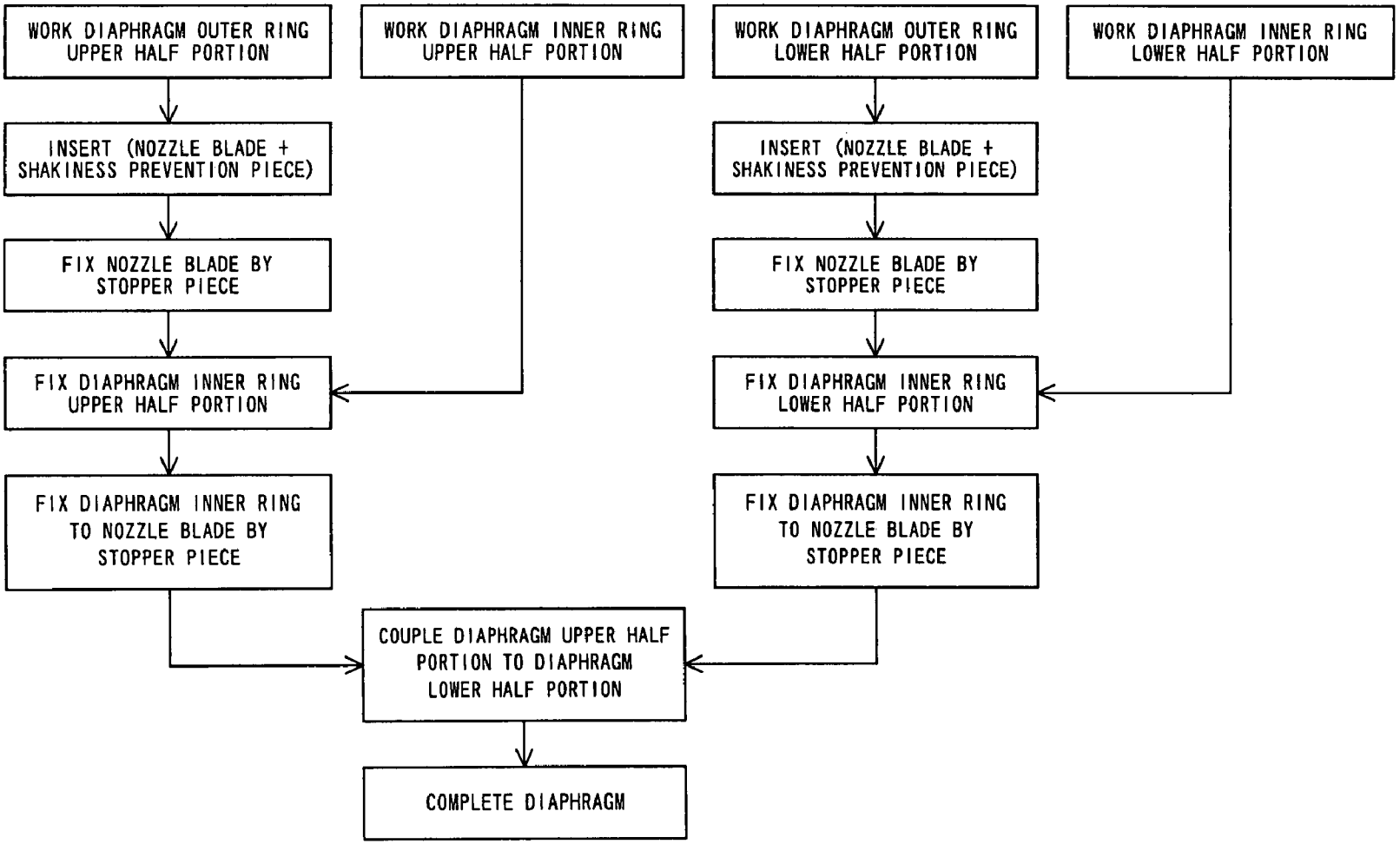
FIG. 22 is a flow chart which illustrates the steps of assembling procedures of the assembled nozzle diaphragm according to the fourth embodiment of the present invention.

Assembling steps of this nozzle diaphragm of the fourth embodiment will be described with reference to the schematic block diagram of FIG. 22. This nozzle diaphragm assembling method differs from that of the first embodiment in that at a time when the nozzle blade is inserted into the diaphragm outer ring, not only the nozzle blade but also shakiness prevention pieces can be inserted into the diaphragm outer ring and in that the shakiness prevention pieces are fastened by the bolt applied to the hook portion of the diaphragm outer ring to thereby fix or fasten the nozzle blades. Further, the steps other than the above steps are substantially the same as those in the first embodiment shown in FIG. 21, so that they will not be described herein.

Figure 14:
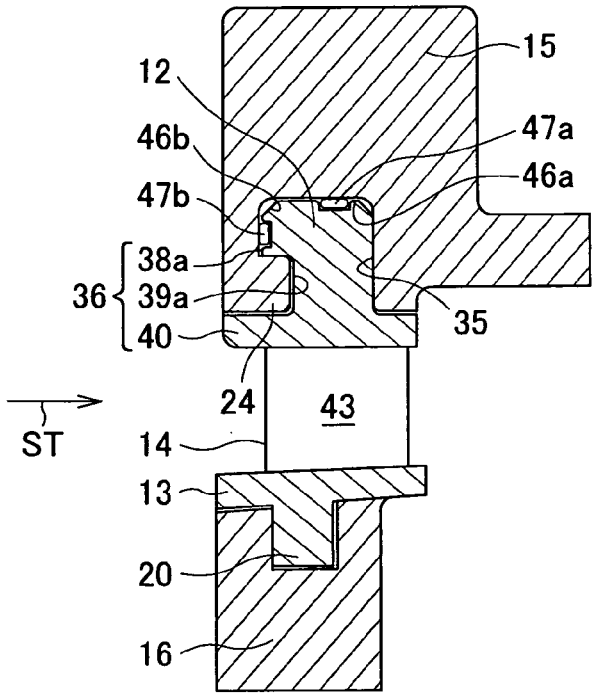
FIG. 14 is a sectional view illustrating a fifth embodiment of the assembled nozzle diaphragm according to the present invention.

FIG. 14 is an elevational section illustrating the assembled nozzle diaphragm according to the fifth embodiment of the present invention. In FIG. 14, the same constituent elements as those in the second embodiment are denoted by the same reference numerals.

According to the assembled nozzle diaphragm in the fifth embodiment, the cap groove 35 provided with the protruded hook portion is formed in the inlet-side diaphragm outer ring 15, the upstream side surface 36 of the diaphragm outer ring insertion portion 12 fitted into this groove 35, the surface 36 being directed toward the flow of the steam ST, is formed in combination of the protruded hook portion 38*a*, the stepped block portion 39*a*.

A shakiness prevention piece 47*a* is provided on a coupled surface 46*a* coupled with the diaphragm outer ring 15 on the head side of the protruded hook portion 38*a* to be parallel to the flow of the steam ST, and a shakiness prevention piece 47*b* is also provided on a coupled surface 46*b* on the diameter direction side of the hook portion 38*a* of the upstream side surface of the diaphragm outer ring insertion portion 12. According to such arrangement, the shakiness prevention piece 47*a* prevents the shakiness of the diaphragm outer ring insertion portion 12 in the flow direction of the steam ST (direction of the steam turbine shaft), and on the other hand, the shakiness prevention piece 47*b* prevents the shakiness of the diaphragm outer ring insertion portion 12 in the diameter direction (direction orthogonal to the flow of the steam ST).

The other constituent elements are substantially the same as those in the first embodiment, so that they will not be described herein.

Further, the continuous hook portion 38*a*, block portion 39*a*, and base portion 40 are all formed together with the nozzle blade 14 by precision forging or by being integrally cut out from a nozzle blade element assembly by the machining work.

As is apparent from the above, according to this embodiment, at the time when the diaphragm outer ring insertion portion 12 is fitted and inserted into the diaphragm outer ring 15, the coupled surface 46*a* coupled with the diaphragm outer ring 15 on the head side of the protruded hook portion 38*a* of the diaphragm outer ring insertion portion 12 parallel to the flow of the steam ST and the coupled surface 46*b* coupled with the diaphragm outer ring 15 on the diameter direction side of the hook portion 38*a* are provided with the shakiness prevention pieces 47*a* and 47*b*, respectively. Therefore, it is ensured that the shakiness of the turbine nozzle can be prevented from causing and the turbine nozzle can be operated stably.

Further, in this embodiment, as mentioned above, since the coupled surfaces 46*a* and 46*b* are provided with the shakiness prevention pieces 47*a* and 47*b*, respectively, it is not necessary to improve the accuracy of the fitting gap between the diaphragm outer ring insertion portion 12 and the diaphragm outer ring 15, thus reducing the working cost.

Figure 15:
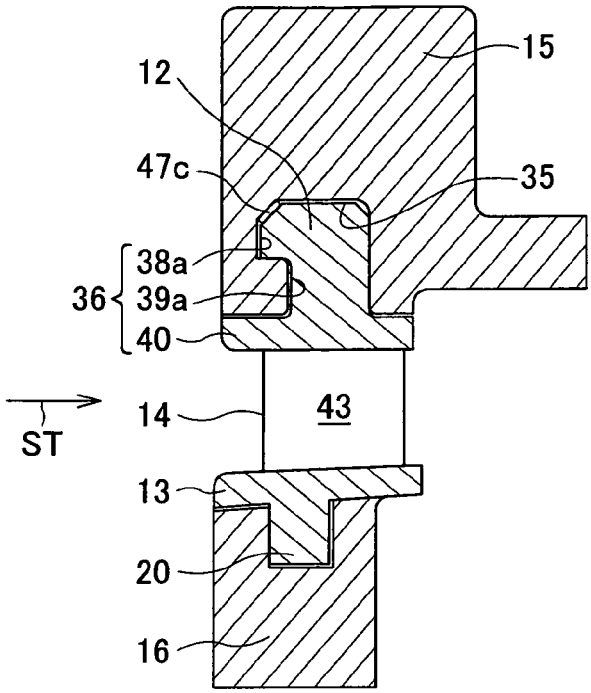
FIG. 15 is a sectional view illustrating a sixth embodiment of the assembled nozzle diaphragm according to the present invention.

Further, in this embodiment, in the diaphragm outer ring insertion portion 12, the coupled surface 46*a* coupled with the diaphragm outer ring 15 on the head side of the protruded hook portion 38*a* parallel to the flow of the steam ST and the coupled surface 46*b* coupled with the diaphragm outer ring 15 on the diameter direction side of the hook portion 38*a* are provided with the shakiness prevention pieces 47*a* and 47*b*, respectively. However, the present invention is not limited to such arrangement of this embodiment, and as illustrated in FIG. 15, as sixth embodiment, for example, in the diaphragm outer ring insertion portion 12, a shakiness prevention piece 47*c* may be further provided on a corner (shoulder) portion of the upstream side surface 36 on the head side of the protruded hook portion 38*a*. Particularly, in the case where the shakiness prevention piece 47*c* is provided on the corner of the protruded hook portion 38*a*, it is possible to effectively prevent the shakiness of the diaphragm outer ring insertion portion 12 in both the flow direction of the steam ST and the direction orthogonal to the flow of the steam ST.

Figure 16:
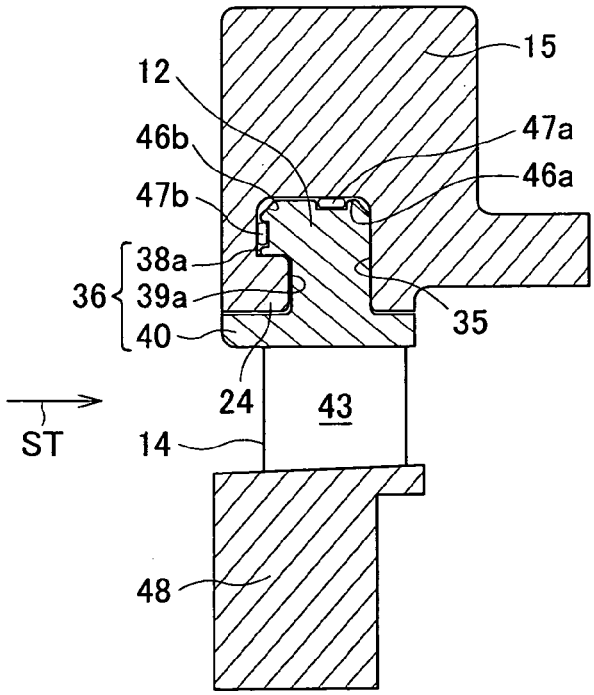
FIG. 16 is a sectional view illustrating a seventh embodiment of the assembled nozzle diaphragm according to the present invention.

FIG. 16 is an elevational section illustrating the seventh embodiment of the assembled nozzle diaphragm according to the present invention. In FIG. 16, the same constituent elements as those in the second embodiment are denoted by the same reference numerals.

In the assembled nozzle diaphragm of this embodiment, the diaphragm outer ring insertion 12 provided on one end of the nozzle blade (nozzle plate) 14 and the diaphragm outer ring 15, to which this diaphragm outer ring insertion portion 12 is fitted, are constituted substantially equally to those in the fourth embodiment shown in FIG. 14. A nozzle blade inner periphery-side member 48 is provided, integrally with the nozzle blade 14, on the other end of the nozzle blade 14. That is, in this embodiment, the nozzle blade inner periphery-side member 48 is formed integrally with the nozzle blade 14 in place of the diaphragm inner ring insertion portion 13 and the diaphragm inner ring shown in FIG. 14. This embodiment is effective for the case in which the distance between the nozzle blade 14 and the turbine shaft, not shown, is small.

Figure 23:
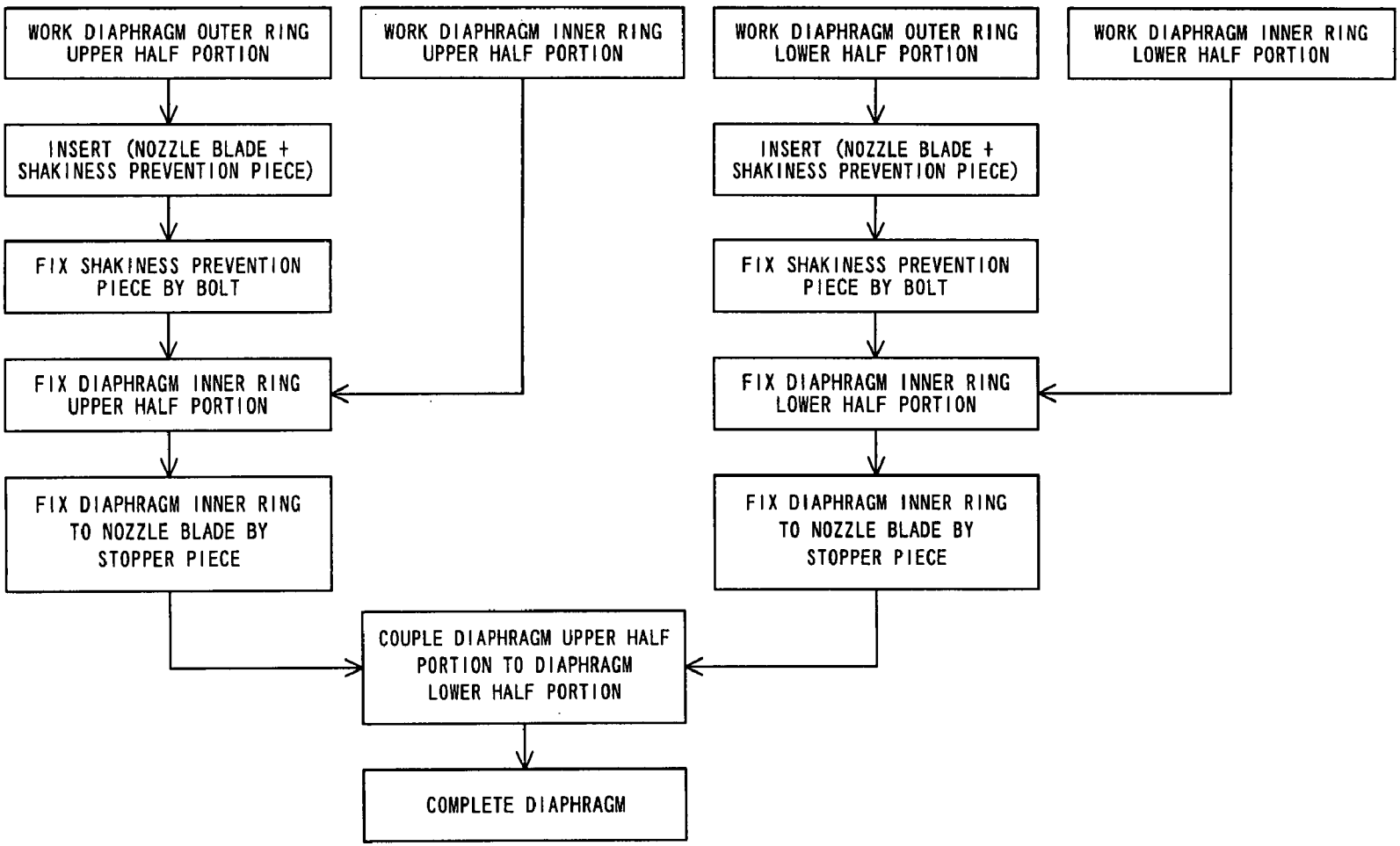
FIG. 23 is a flow chart which illustrates the steps of assembling procedures of the assembled nozzle diaphragm according to the fifth to seventh embodiments of the present invention.
Figure 24:
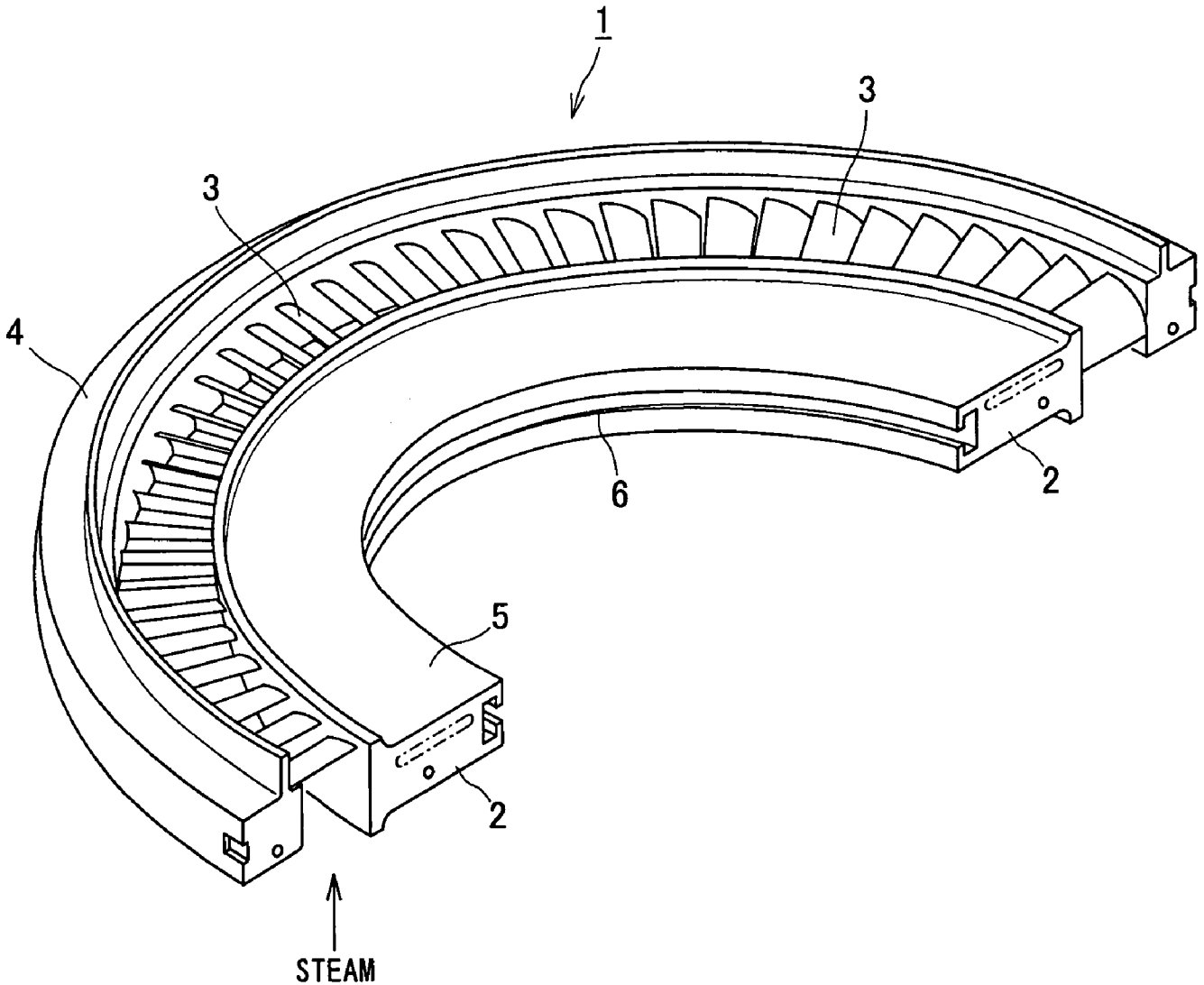
FIG. 24 is a perspective view illustrating a conventional nozzle diaphragm divided in half.
Figure 25:
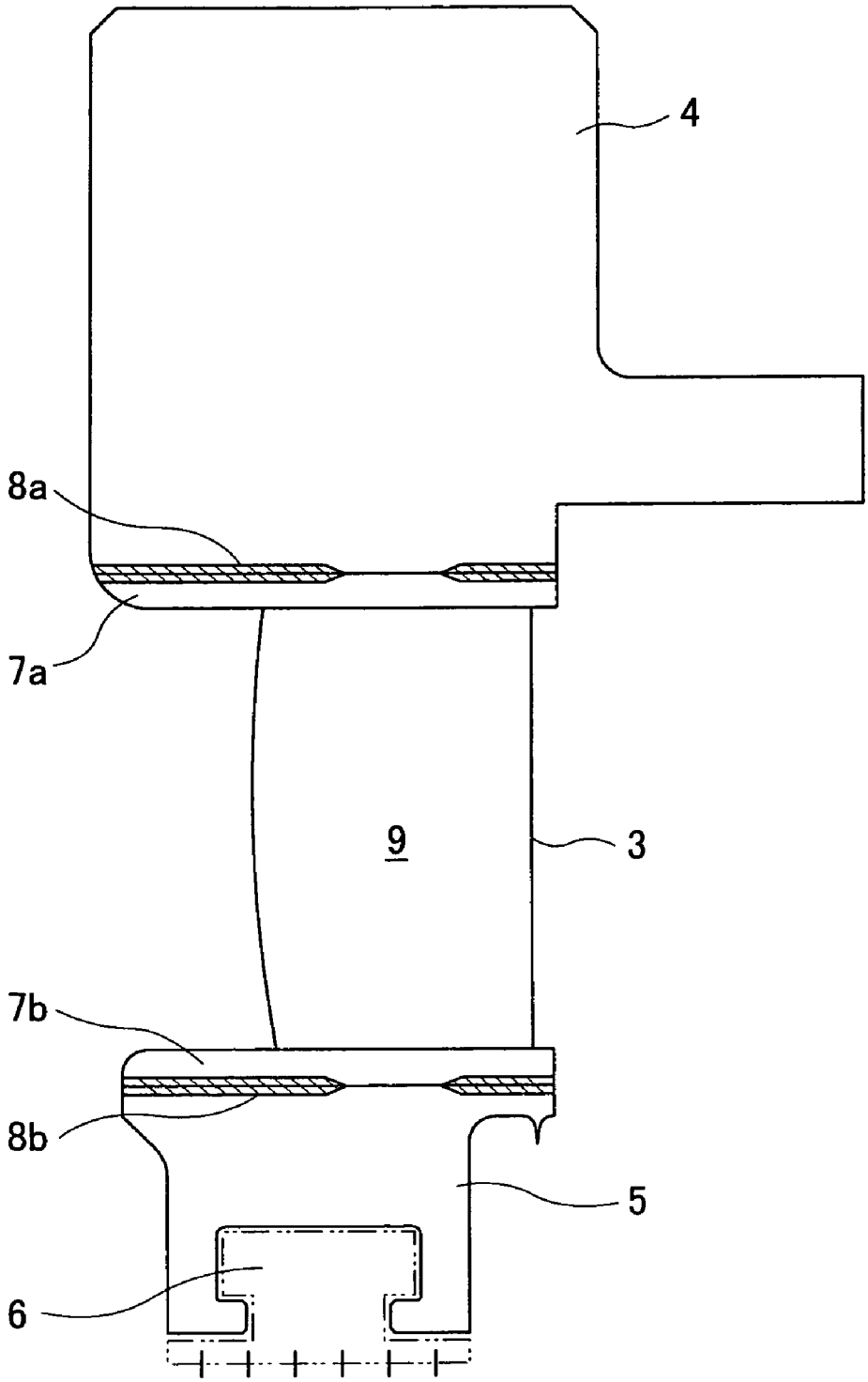
FIG. 25 illustrates a conventional nozzle diaphragm of a weld type.
Figure 26:
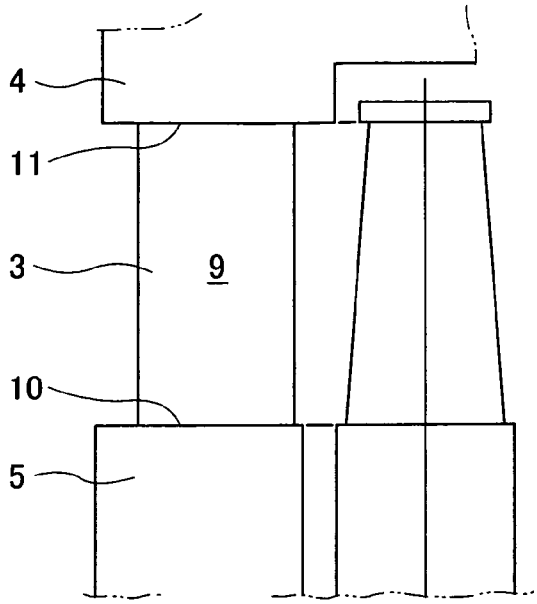
FIG. 26 is an illustration used to explain a designed path width of a steam path.
Figure 27:
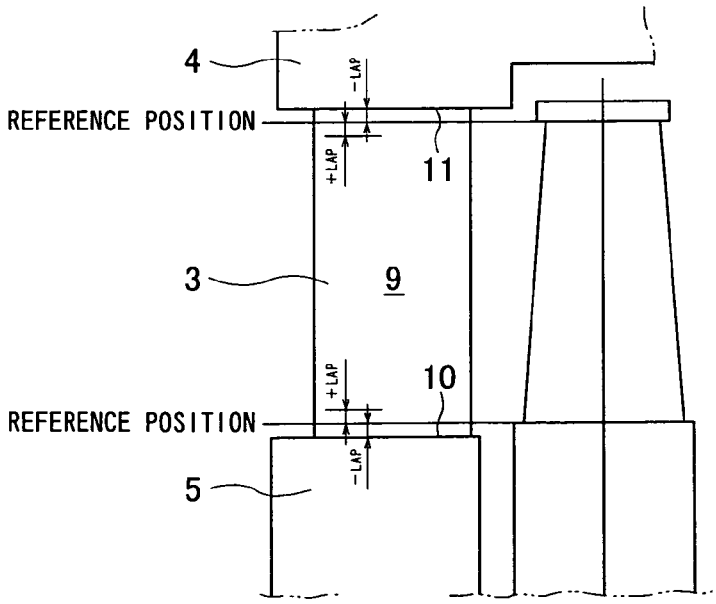
FIG. 27 is an illustration used to explain an actual path width of the steam path.
Figure 28:
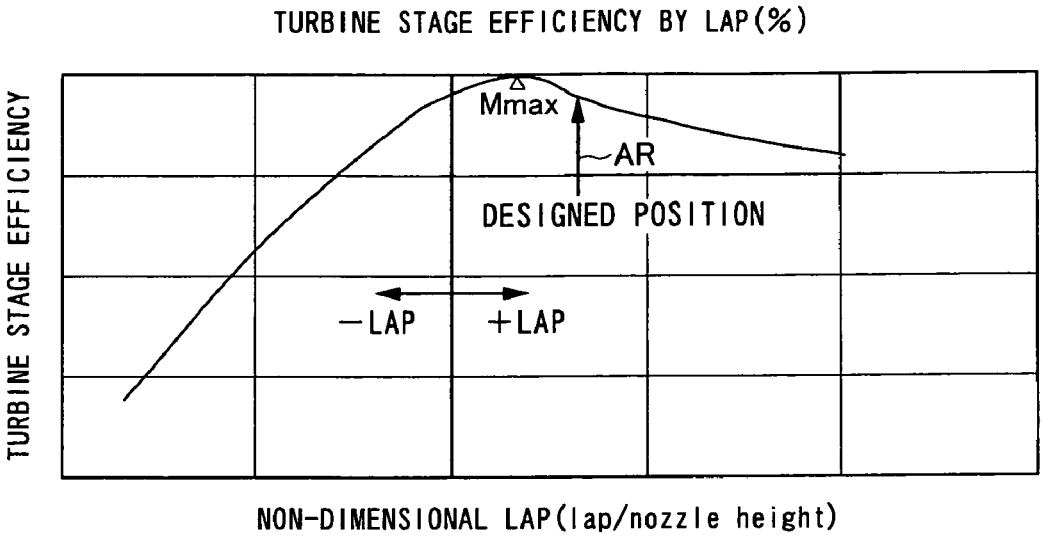
FIG. 28 is a diagram which shows a fluctuation in turbine stage efficiency due to a fluctuation in a lap of the steam path width.
Figure 29:
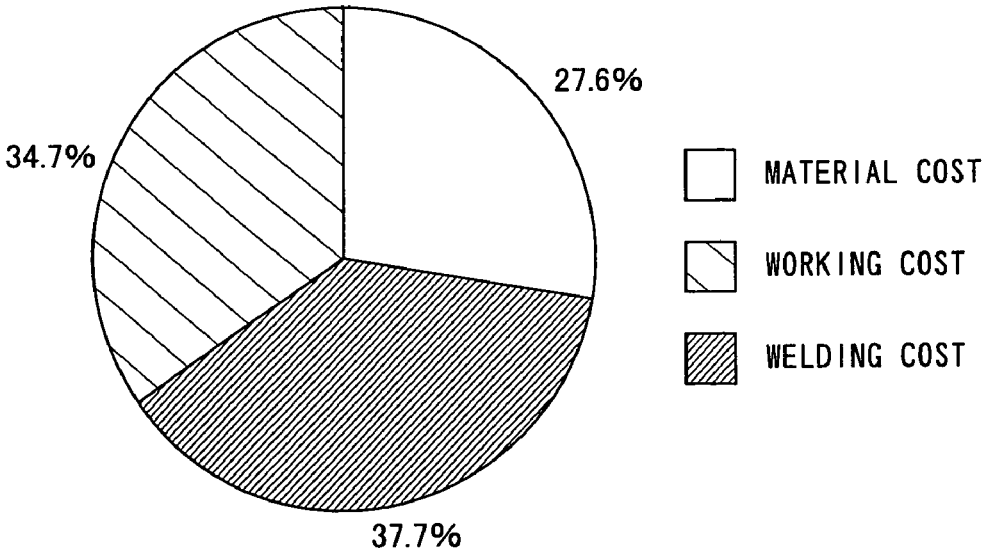
FIG. 29 is a circular graph which illustrates details of a manufacturing cost of the conventional turbine nozzle.
Figure 30:
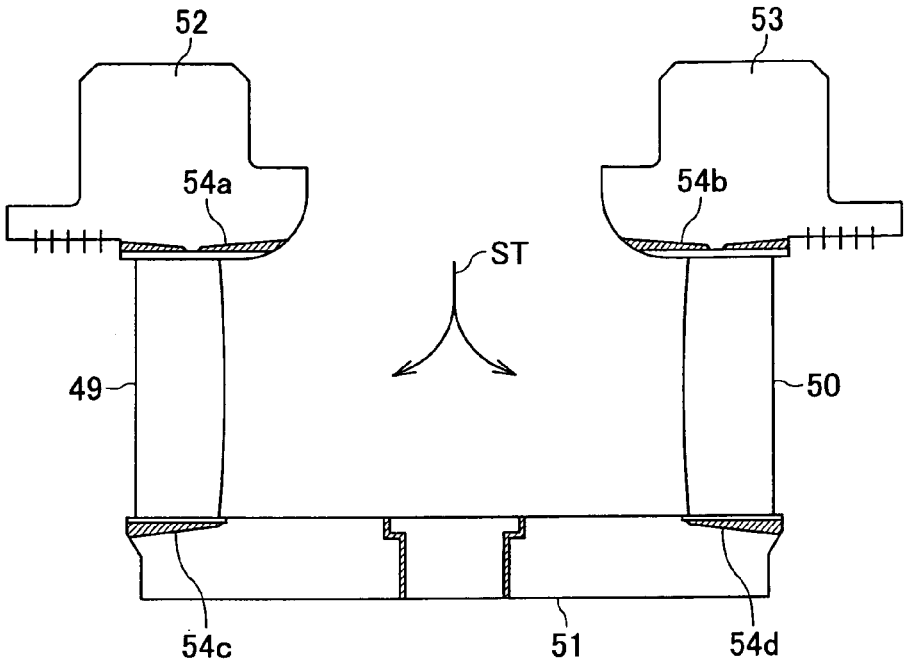
FIG. 30 illustrates a nozzle diaphragm of the conventional weld type and a counter-flow (double flow) type.

Assembling steps of the nozzle diaphragm assembling method of the fifth to seventh embodiments are described through the schematic block diagram of FIG. 23. The nozzle diaphragm assembling method of this fifth to seventh embodiments differs from that in the first embodiment in that when the nozzle blade is inserted into the diaphragm outer ring, not only the nozzle blade but also the shakiness prevention pieces are inserted into the diaphragm outer ring. Further, the other steps are substantially the same as those of the first embodiment shown in FIG. 21, so that they will not be described herein.

Figure 17:
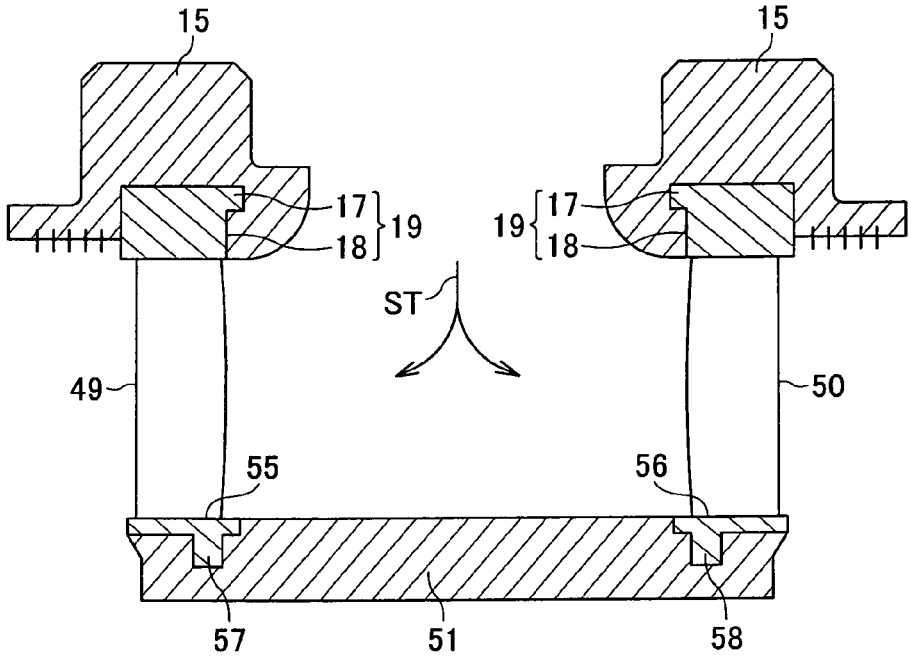
FIG. 17 is a sectional view illustrating an eighth embodiment of the assembled nozzle diaphragm according to the present invention.

FIG. 17 is an elevational section illustrating the eighth embodiment of the assembled nozzle diaphragm according to the present invention. In FIG. 17, the same constituent elements as those in the first embodiment are denoted by the same reference numerals.

The assembled nozzle diaphragm in this embodiment is applied to the steam turbine which operates to divide the flow of the steam to the left flow and the right flow, such steam turbine being so-called a counter-flow (double flow) type. First and second divided-flow diaphragm inner ring insertion portions 55 and 57 formed to bottoms of the first and second divided-flow nozzle blades 49 and 50 for the steam ST are provided with convex columnar pieces 57 and 58, respectively. The columnar pieces 57 and 58 are fitted to a shared diaphragm inner ring 51 shared between the first and second divided-flow nozzle blades 49 and 50.

The first and second divided-flow diaphragm outer rings 52 and 53 fitted into first and second divided-flow diaphragm outer ring insertion portions 55 and 56 of the first and second divided-flow nozzle blades 49 and 50 are the same in configuration as the outer ring in the first embodiment, so that they will not be described herein.

As can be seen from the above, according to this embodiment, the first and second divided-flow diaphragm inner ring insertion portions 55 and 56 of the first and second divided-flow nozzle blade 49 and 50 are fitted into the shared diaphragm inner ring 51 shared between the first and second divided-flow nozzle blades 49 and 50. It is, therefore, possible to further reduce the manufacturing cost and labor of the worker. When the assembled nozzle diaphragm is applied to the steam turbine, it is possible to continuously perform the stable operation for a long term without causing any problem of the distortion based on the welding such as in the conventional art.

Figure 20:
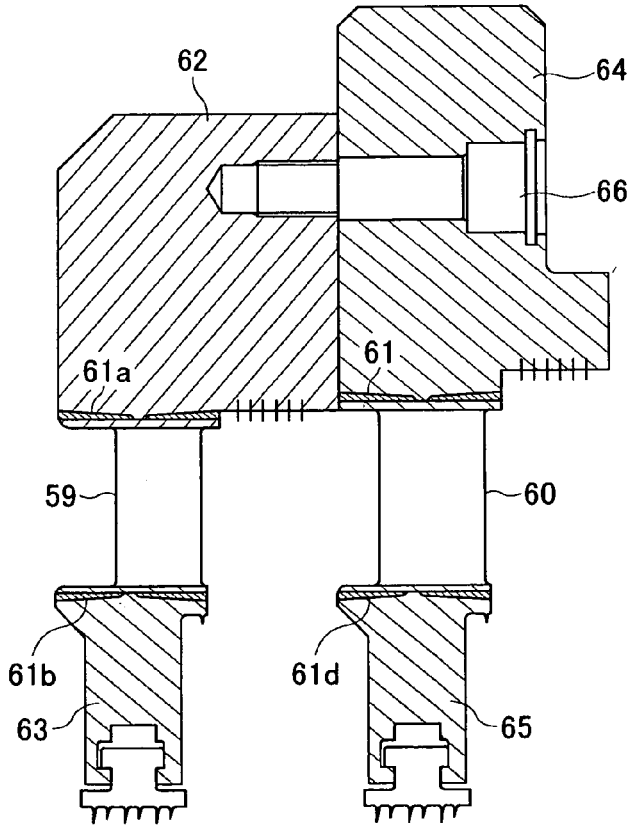
FIG. 20 is a sectional view illustrating an eleventh embodiment of the assembled nozzle diaphragm according to the present invention.

In this eighth embodiment, the example of applying the assembled nozzle diaphragm to the counterflow-type steam turbine has been described. However, the present invention is not limited to this counterflow-type steam turbine, and as shown in, for example, FIG. 20, the assembled nozzle diaphragm of a fitting structure may be applied to so-called tie-in turbine stages constituted so that a first stage diaphragm outer ring 62, to which a first stage nozzle blade 59 and a second stage nozzle blade 60 are fixed through welding portions 61*a*, 61*b*, 61*c*, and 61*d*, is connected to a second stage nozzle diaphragm outer ring 64 by means of bolt 66.

In this example, the assembled nozzle diaphragm may be applied only to the first stage nozzle diaphragm outer ring 62 and the second stage nozzle diaphragm outer ring 64 or up to a first stage nozzle diaphragm inner ring 63 and a second stage nozzle diaphragm inner ring 65.

Figure 18:
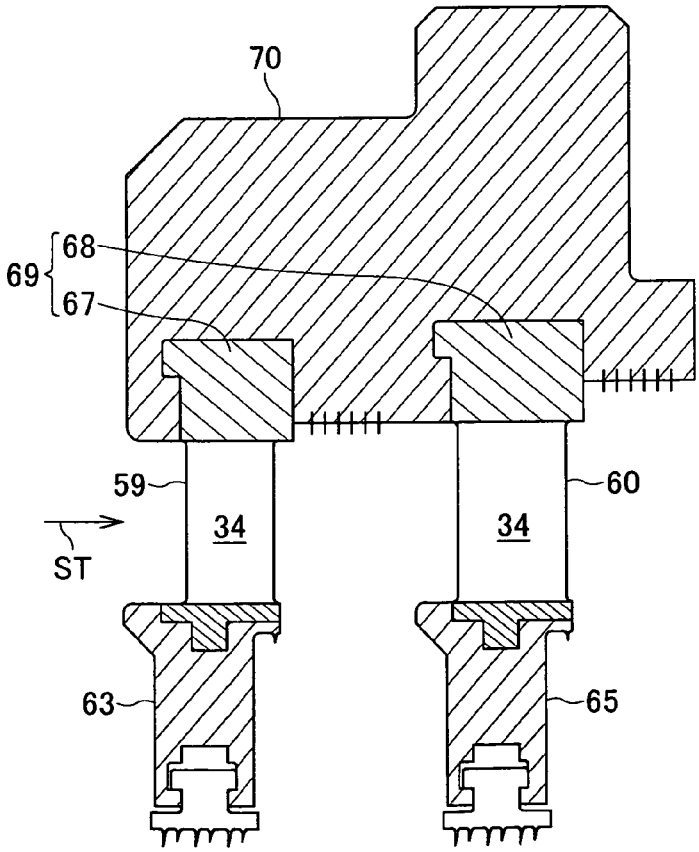
FIG. 18 is a sectional view illustrating a ninth embodiment of the assembled nozzle diaphragm according to the present invention.

FIG. 18 is an elevational section illustrating the ninth embodiment of the assembled nozzle diaphragm according to the present invention. In FIG. 18, the same constituent elements as those in the first embodiment are denoted by the same reference numerals.

In the assembled nozzle diaphragm in this embodiment, multiple-stage diaphragm outer ring insertion portions 69 such as a first stage nozzle diaphragm outer ring insertion portion 67 of a first stage nozzle blade 59 and a second stage diaphragm outer ring insertion portion 68 of a second stage nozzle blade 60 are collectively fitted into a multiple-stage diaphragm outer ring 70.

Further, the other constituent elements are substantially the same to those in the first embodiment, so that they will not be described herein.

As can be seen, in this embodiment, the multiple-stage diaphragm outer ring insertion portions 69 such as the first stage nozzle diaphragm outer ring insertion portion 67 of the first stage nozzle blade 59 and the second stage diaphragm outer ring insertion portion 68 of the second stage nozzle blade 60 are collectively fitted to the multiple-stage diaphragm outer ring 70. Therefore, when the assembling operation is performed, the number of assembling steps and labor of the workers can be further reduced.

Figure 19:
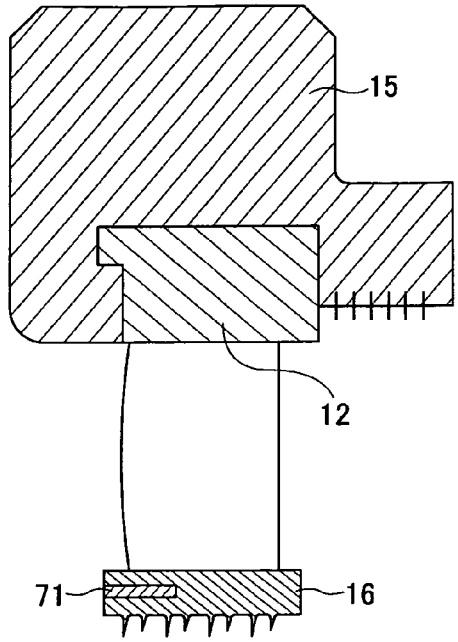
FIG. 19 is a sectional view illustrating a tenth embodiment of the assembled nozzle diaphragm according to the present invention.

FIG. 19 is an elevational section illustrating the tenth embodiment of the assembled nozzle diaphragm according to the present invention. In FIG. 19, the same constituent elements as those in the first embodiment are denoted by the same reference numerals.

In the assembled nozzle diaphragm in this embodiment, a plate 71 of a fixed type, for example, is inserted into the diaphragm inner ring 16 in the circumferential direction. Further, the other constituent elements are substantially the same as those in the first embodiment, so that they will not be described herein.

As can be seen from the above, according to this embodiment, the stiffness of the assembled nozzle diaphragm can be intensified by inserting the fixed plate 71 into the diaphragm inner ring 16. It is therefore possible to effectively deal with cracks and the like based on an unexpected vibration resulting from an intermittent fluctuation in the steam flow or a pressure fluctuation. This embodiment will be particularly effective for the case that the diaphragm inner ring has low stiffness.

INDUSTRIAL APPLICABILITY

As described hereinbefore, the assembled nozzle diaphragm utilizes the simple assembly structure in which the diaphragm outer ring insertion portion provided on one end of the nozzle blade is fitted to the diaphragm outer ring and in which the diaphragm inner ring insertion portion provided on the other end of the nozzle blade is fitted to the diaphragm inner ring. Therefore, in the case where the assembled nozzle diaphragm according to the present invention is applied to, for example, the steam turbine, the width of the steam path can be kept exactly at the designed dimension, and the turbine nozzle can be operated with far higher turbine stage efficiency.

In addition, according to the nozzle diaphragm assembling method of the present invention, the nozzle blade can be freely moved relative to the diaphragm inner and outer rings. Accordingly, even if a damage such as a crack occurs to the nozzle blade during the operation of the steam turbine, it suffices to exchange only the nozzle blade to which the damage or the like occurs, and moreover, even in such case, differently from the conventional art, it is not necessary to exchange the entire diaphragm and it is thereby possible to further reduce exchange operation. The present invention is thus be applicable to industrial usage.

The invention claimed is:

1. A nozzle diaphragm assembly comprising:

a diaphragm outer ring having an inner groove radially opened toward an inner side continuously along an inner circumferential direction of the diaphragm outer ring;

a diaphragm inner ring having an outer groove radially opened toward an outer side continuously along an outer circumferential direction of the diaphragm inner ring; and a nozzle blade having an outer insertion portion for the diaphragm outer ring provided on one end and an inner insertion portion for the diaphragm inner ring provided on the other end, wherein the inner groove of the diaphragm outer ring and the outer insertion portion of the nozzle blade are shaped to be fitted to each other only in the inner circumferential direction of the diaphragm outer ring, and the outer groove of the diaphragm inner ring, and the inner insertion portion of the nozzle blade are shaped to be fitted to each other only in one of the outer circumferential direction and a radial direction of the diaphragm inner ring, and wherein the outer insertion portion of the nozzle blade includes a protruded hook portion, which is protruded from the outer insertion portion, provided only at an upstream side of a fluid flow of the outer insertion portion, and a stepped block portion which includes at least one recessed portion and at least one projecting portion, provided continuously to the protruded hook portion, in which the protruded hook portion and the stepped block portion extend in a circumferential direction to be fitted with the inner groove of the diaphragm outer ring.

2. The nozzle diaphragm assembly according to claim 1, wherein the inner insertion portion of the nozzle blade has a convex columnar piece formed at an intermediate position and the convex columnar piece extends in the circumferential direction.

3. The nozzle diaphragm assembly according to claim 1, wherein the diaphragm outer ring has a cap groove formed in the circumferential direction, the cap groove including a protruded hook portion, which is protruded toward the upstream side of fluid flow.

4. The nozzle diaphragm assembly according to claim 1, wherein the diaphragm inner ring has a concave groove formed in the circumferential direction.

5. The nozzle diaphragm assembly according to claim 1, wherein a fitting gap between the diaphragm outer ring insertion portion and the diaphragm outer ring is set to be in a range of 0.03 to 0.12 millimeters.

6. The nozzle diaphragm assembly according to claim 5, wherein the fitting gap set to be in the range of 0.03 to 0.12 millimeters between the outer insertion portion and the inner groove of the diaphragm outer ring is at least one of a gap between an outer circumferential surface on the outer insertion portion and the diaphragm outer ring and a gap between a radial surface at an upstream side of the outer insertion portion and the diaphragm outer ring.

7. The nozzle diaphragm assembly according to claim 1, wherein a fitting gap between the inner insertion portion and the diaphragm inner ring is set to be in a range of 0.03 to 0.12 millimeters.

8. The nozzle diaphragm assembly according to claim 7, wherein the fitting gap set to be in the range of 0.03 to 0.12 millimeters between the inner insertion portion and the diaphragm inner ring is a radial gap between a surface of the inner insertion portion and the diaphragm inner ring.

9. The nozzle diaphragm assembly according to claim 1, wherein the outer insertion portion is constituted in combination of a columnar piece directed toward the radial direction and a protruded base portion provided to be continuous to the columnar piece.

10. The nozzle diaphragm assembly according to claim 1, wherein the outer insertion portion further includes a protruded base portion continuously provided to the block portion a ring piece attached to the block portion, and a means for fixing the outer insertion portion provided on the outer ring so as to apply a pressing force to the outer insertion portion.

11. The nozzle diaphragm assembly according to claim 1, wherein the outer insertion portion further includes a protruded base portion continuously provided to the block portion, and a shakiness prevention piece provided on a surface between the outer insertion portion and the diaphragm outer ring.

12. The nozzle diaphragm assembly according to claim 11, wherein the shakiness prevention piece is provided at least one of a gap between an outer circumferential surface of the outer insertion portion and the diaphragm outer ring and a gap between a radial surface at an upstream side of the outer insertion portion and the diaphragm outer ring.

13. The nozzle diaphragm assembly according to claim 11, wherein the shakiness prevention piece is provided in a corner of an outer circumferential surface of the outer insertion portion.

14. The nozzle diaphragm assembly according to claim 1, wherein a plurality of the nozzle blades each supported by the diaphragm outer ring and the diaphragm inner ring are arranged at counterflow positions along the fluid flow to be divided, and the plurality of nozzle blades arranged at the counterflow positions are supported by the single diaphragm inner ring.

15. The nozzle diaphragm assembly according to claim 1, wherein a plurality of the nozzle blades each supported by the diaphragm outer ring and the diaphragm inner ring are arranged along the fluid flow, and the outer ring portion of each of the plurality of nozzle blades arranged along the fluid flow is supported by the single diaphragm outer ring.

16. A nozzle diaphragm assembly comprising:

a diaphragm outer ring having an inner groove radially opened toward an inner side continuously along an inner circumferential direction of the diaphragm outer ring; and a nozzle blade having an outer insertion portion for the diaphragm outer ring provided on one end and an inner periphery-side member formed integrally with the nozzle blade on the other end, wherein the diaphragm inner ring is formed by the inner periphery-side member of the nozzle blades, wherein the outer insertion portion of the nozzle blade comprises a protruded hook portion which is protruded from the outer insertion portion, provided only at an upstream side of a fluid flow of the outer insertion portion, and a stepped block portion which includes at least one recessed portion and at least one projecting portion, provided continuously to the protruded hook portion, in which the protruded hook portion and the stepped block portion extend in a circumferential direction to be fitted with the inner groove of the diaphragm outer ring.

17. The nozzle diaphragm assembly according to claim 16, wherein the diaphragm outer ring includes a shakiness prevention piece on a fitting surface on which the diaphragm outer ring insertion portion is fitted into the diaphragm outer ring.

18. The nozzle diaphragm assembly according to claim 16, wherein a plate is inserted into the diaphragm inner ring.

19. A method of assembling a nozzle diaphragm which comprises: a diaphragm outer ring having a groove opened toward an inner diameter side to be continuous in an inner peripheral direction of the diaphragm outer ring; a diaphragm inner ring having a groove opened toward an outer diameter side to be continuous in an outer peripheral direction of the diaphragm inner ring; and a nozzle blade having an insertion portion for the diaphragm outer ring provided on one end and an insertion portion for the diaphragm inner ring provided on the other end, said method comprising the steps of:

working the diaphragm outer ring to be divided in half to a diaphragm outer ring upper half portion and a diaphragm outer ring lower half portion at a horizontal joint surface position substantially at 180 degrees so as to constitute the diaphragm outer ring of a ring body;

working the diaphragm inner ring to be divided in half to a diaphragm inner ring upper half portion and a diaphragm inner ring lower half portion at a horizontal joint surface position substantially at 180 degrees so as to constitute the diaphragm inner ring of the ring body;

fitting the diaphragm outer ring insertion portion of the nozzle blade from a horizontal joint surface of one of the diaphragm outer ring upper half portion and the diaphragm outer ring lower half portion toward a horizontal joint surface of the other one of the diaphragm outer ring upper half portion and the diaphragm outer ring lower half portion to sequentially insert, one by one, the nozzle blades of a preset number in a circumferential direction;

fixing the plurality of inserted nozzle blades by stopper pieces on the horizontal joint surfaces of the one half portion and on the horizontal joint surface of the other half portion, respectively;

inserting the diaphragm inner ring upper half portion and the diaphragm inner ring lower half portion into the inner ring insertion portion of the nozzle blade from an inside diameter direction of the inner ring insertion portion;

fixing the plurality of inserted nozzle blades by stopper pieces on the horizontal joint surface of the inserted diaphragm inner ring upper half portion and the horizontal joint surface of the inserted diaphragm inner ring lower half portion, respectively; and fixing the diaphragm inner ring upper half portion and the diaphragm outer ring upper half portion integrated with the nozzle blades of the preset number to the diaphragm inner ring lower half portion and the diaphragm outer ring lower half portion integrated with the nozzle blades of the preset number on the respective horizontal joint surfaces.

20. The nozzle diaphragm assembling method according to claim 19, wherein a fitting gap between the diaphragm outer ring insertion portion and the diaphragm outer ring is set to be in a range of 0.03 to 0.12 millimeters.

21. The nozzle diaphragm assembling method according to claim 20, wherein the fitting gap set to be in the range of 0.03 to 0.12 millimeters between the diaphragm outer ring insertion portion and the diaphragm outer ring is at least one of a gap between a surface on a head side of the diaphragm outer ring insertion portion parallel to a flow of a fluid and the diaphragm outer ring and a gap between a surface on an upstream side surface of the diaphragm outer ring insertion portion in the diameter direction and the diaphragm outer ring.

22. The nozzle diaphragm assembling method according to claim 19, wherein a fitting gap between the diaphragm inner ring insertion portion and the diaphragm inner ring is set to be in a range of 0.03 to 0.12 millimeters.

23. The nozzle diaphragm assembling method according to claim 22, wherein the fitting gap set to be in the range of 0.03 to 0.12 millimeters between the diaphragm inner ring insertion portion and the diaphragm inner ring is in the diameter direction of a columnar piece of the diaphragm inner ring insertion portion.

* * * * *